US009242346B2

(12) United States Patent
Gaeta et al.

(10) Patent No.: US 9,242,346 B2
(45) Date of Patent: Jan. 26, 2016

(54) ABRASIVE PRODUCTS HAVING FIBRILLATED FIBERS

(71) Applicants: Anthony C. Gaeta, Lockport, NY (US); Anuj Seth, Northborough, MA (US); Charles G. Herbert, Shrewsbury, MA (US); Darrell K. Everts, Hudson Falls, NY (US); Frank J. Csillag, Hopkinton, MA (US); Julienne Labrecque, Worcester, MA (US); Kamran Khatami, East Greenwich, RI (US)

(72) Inventors: Anthony C. Gaeta, Lockport, NY (US); Anuj Seth, Northborough, MA (US); Charles G. Herbert, Shrewsbury, MA (US); Darrell K. Everts, Hudson Falls, NY (US); Frank J. Csillag, Hopkinton, MA (US); Julienne Labrecque, Worcester, MA (US); Kamran Khatami, East Greenwich, RI (US)

(73) Assignee: SAINT-GOBAIN ABRASIVES, INC., Worcester, MA (US)

( * ) Notice: Subject to any disclaimer, the term of this patent is extended or adjusted under 35 U.S.C. 154(b) by 71 days.

(21) Appl. No.: 13/853,994

(22) Filed: Mar. 29, 2013

(65) Prior Publication Data

US 2013/0305614 A1 Nov. 21, 2013

Related U.S. Application Data

(60) Provisional application No. 61/618,007, filed on Mar. 30, 2012.

(51) Int. Cl.

| | |
|---|---|
| ***B24D 3/28*** | (2006.01) |
| ***B24D 3/20*** | (2006.01) |
| ***B24D 11/00*** | (2006.01) |

(52) U.S. Cl.
CPC .. *B24D 3/28* (2013.01); *B24D 3/20* (2013.01); *B24D 11/001* (2013.01)

(58) Field of Classification Search
CPC ..... B24D 3/00; B24D 11/00; B24D 3/004; C09G 1/00; C09K 3/00; C09K 3/14
See application file for complete search history.

(56) References Cited

U.S. PATENT DOCUMENTS

| | | | |
|---|---|---|---|
| 345,604 | A | 7/1886 | Semper |
| 1,910,444 | A | 5/1933 | Nicholson |
| 2,049,874 | A | 8/1936 | Sherk |
| 2,148,400 | A | 2/1939 | Crompton, Jr. |
| 2,248,990 | A | 7/1941 | Heany |
| 2,290,877 | A | 7/1942 | Heany |
| 2,318,360 | A | 5/1943 | Benner et al. |
| 2,376,343 | A | 5/1945 | Carlton |
| 2,563,650 | A | 8/1951 | Heinemann et al. |

(Continued)

FOREIGN PATENT DOCUMENTS

| | | | |
|---|---|---|---|
| CA | 743715 | A | 10/1966 |
| CH | 685051 | A5 | 3/1995 |

(Continued)

OTHER PUBLICATIONS

DuPont Kevlar Pulp Product Information; 1999.*

(Continued)

*Primary Examiner* — Pegah Parvini
*Assistant Examiner* — Alexandra M Moore
(74) *Attorney, Agent, or Firm* — Abel Law Group, LLP; Joseph P Sullivan

(57) ABSTRACT

An engineered coated abrasive product having a backing, a frontfill coat, a make coat, and/or a size coat, wherein at least one of the coats includes fibrillated fibers. The coated abrasive product is capable of improved inter-layer adhesion, retention of abrasive grains, and/or maintenance of abrasive grains in a more desirable orientation for grinding.

6 Claims, 14 Drawing Sheets

(56) References Cited

U.S. PATENT DOCUMENTS

| | | | |
|---|---|---|---|
| 2,880,080 | A | 3/1959 | Rankin et al. |
| 3,041,156 | A | 6/1962 | Rowse et al. |
| 3,067,551 | A | 12/1962 | Maginnis |
| 3,079,242 | A | 2/1963 | Glasgow |
| 3,079,243 | A | 2/1963 | Ueltz |
| 3,123,948 | A | 3/1964 | Kistler et al. |
| 3,141,271 | A | 7/1964 | Fischer et al. |
| 3,276,852 | A | 10/1966 | Lemelson |
| 3,377,660 | A | 4/1968 | Marshall et al. |
| 3,379,543 | A | 4/1968 | Norwalk |
| 3,387,957 | A | 6/1968 | Howard |
| 3,454,385 | A | 7/1969 | Amero |
| 3,477,180 | A | 11/1969 | Robertson, Jr. |
| 3,480,395 | A | 11/1969 | McMullen et al. |
| 3,481,723 | A | 12/1969 | Kistler et al. |
| 3,491,492 | A | 1/1970 | Ueltz |
| 3,495,359 | A | 2/1970 | Smith et al. |
| 3,536,005 | A | 10/1970 | Derrickson |
| 3,590,799 | A | 7/1971 | Gluchowicz |
| 3,608,050 | A | 9/1971 | Carman et al. |
| 3,615,308 | A | 10/1971 | Amero |
| 3,619,151 | A | 11/1971 | Sheets, Jr. et al. |
| 3,637,360 | A | 1/1972 | Ueltz et al. |
| 3,672,934 | A | 6/1972 | Larry |
| 3,819,785 | A | 6/1974 | Argyle et al. |
| 3,859,407 | A | 1/1975 | Blanding et al. |
| 3,874,856 | A | 4/1975 | Leeds |
| 3,909,991 | A | 10/1975 | Coes, Jr. |
| 3,940,276 | A | 2/1976 | Wilson |
| 3,950,148 | A | 4/1976 | Fukuda |
| 3,960,577 | A | 6/1976 | Prochazka |
| 3,977,132 | A | 8/1976 | Sekigawa |
| 3,986,885 | A | 10/1976 | Lankard |
| 3,991,527 | A | 11/1976 | Maran |
| 4,004,934 | A | 1/1977 | Prochazka |
| 4,037,367 | A | 7/1977 | Kruse |
| 4,045,919 | A | 9/1977 | Moritomo |
| 4,055,451 | A | 10/1977 | Cockbain et al. |
| 4,073,096 | A | 2/1978 | Ueltz et al. |
| 4,114,322 | A | 9/1978 | Greenspan |
| 4,150,078 | A | 4/1979 | Miller et al. |
| 4,194,887 | A | 3/1980 | Ueltz et al. |
| 4,252,544 | A | 2/1981 | Takahashi |
| 4,286,905 | A | 9/1981 | Samanta |
| 4,304,576 | A | 12/1981 | Hattori et al. |
| 4,314,827 | A | 2/1982 | Leitheiser et al. |
| 4,341,663 | A | 7/1982 | Derleth et al. |
| 4,393,021 | A | 7/1983 | Eisenberg et al. |
| 4,452,911 | A | 6/1984 | Eccles et al. |
| 4,457,767 | A | 7/1984 | Poon et al. |
| 4,469,758 | A | 9/1984 | Scott |
| 4,505,720 | A | 3/1985 | Gabor et al. |
| 4,541,842 | A | 9/1985 | Rostoker |
| 4,548,617 | A | 10/1985 | Miyatani et al. |
| 4,570,048 | A | 2/1986 | Poole |
| 4,618,349 | A | 10/1986 | Hashimoto et al. |
| 4,623,364 | A | 11/1986 | Cottringer et al. |
| 4,656,330 | A | 4/1987 | Poole |
| 4,657,754 | A | 4/1987 | Bauer et al. |
| 4,659,341 | A | 4/1987 | Ludwig et al. |
| 4,678,560 | A | 7/1987 | Stole et al. |
| 4,711,750 | A | 12/1987 | Scott |
| 4,728,043 | A | 3/1988 | Ersdal et al. |
| 4,744,802 | A | 5/1988 | Schwabel |
| 4,770,671 | A | 9/1988 | Monroe |
| 4,786,292 | A | 11/1988 | Janz et al. |
| 4,797,139 | A | 1/1989 | Bauer |
| 4,797,269 | A | 1/1989 | Bauer et al. |
| 4,799,939 | A | 1/1989 | Bloecher et al. |
| 4,829,027 | A | 5/1989 | Cutler et al. |
| 4,832,706 | A | 5/1989 | Yates |
| 4,848,041 | A | 7/1989 | Kruschke |
| 4,858,527 | A | 8/1989 | Masanao |
| 4,863,573 | A | 9/1989 | Moore et al. |
| 4,876,226 | A | 10/1989 | Fuentes |
| 4,881,951 | A | 11/1989 | Wood et al. |
| 4,917,852 | A | 4/1990 | Poole et al. |
| 4,918,116 | A | 4/1990 | Gardziella et al. |
| 4,925,815 | A | 5/1990 | Tani et al. |
| 4,930,266 | A | 6/1990 | Calhoun et al. |
| 4,942,011 | A | 7/1990 | Bolt et al. |
| 4,954,462 | A | 9/1990 | Wood |
| 4,960,441 | A | 10/1990 | Pellow et al. |
| 4,961,757 | A | 10/1990 | Rhodes et al. |
| 4,963,012 | A | 10/1990 | Tracy |
| 4,964,883 | A | 10/1990 | Morris et al. |
| 4,970,057 | A | 11/1990 | Willkens et al. |
| 4,997,461 | A | 3/1991 | Markhoff-Matheny et al. |
| 5,009,675 | A | 4/1991 | Kunz et al. |
| 5,009,676 | A | 4/1991 | Rue et al. |
| 5,011,508 | A | 4/1991 | Wald et al. |
| 5,011,510 | A | 4/1991 | Hayakawa et al. |
| 5,014,468 | A | 5/1991 | Ravipati et al. |
| 5,024,795 | A | 6/1991 | Kennedy et al. |
| 5,032,304 | A | 7/1991 | Toyota |
| 5,035,723 | A | 7/1991 | Kalinowski et al. |
| 5,035,724 | A | 7/1991 | Pukari et al. |
| 5,042,991 | A | 8/1991 | Kunz et al. |
| 5,049,166 | A | 9/1991 | Kirkendall |
| 5,049,645 | A | 9/1991 | Nagaoka et al. |
| 5,053,367 | A | 10/1991 | Newkirk et al. |
| 5,053,369 | A | 10/1991 | Winkler et al. |
| 5,076,991 | A | 12/1991 | Poole et al. |
| 5,078,753 | A | 1/1992 | Broberg et al. |
| 5,081,082 | A | 1/1992 | Hai-Doo et al. |
| 5,085,671 | A | 2/1992 | Martin et al. |
| 5,090,968 | A | 2/1992 | Pellow |
| 5,094,986 | A | 3/1992 | Matsumoto et al. |
| 5,098,740 | A | 3/1992 | Tewari |
| 5,103,598 | A | 4/1992 | Kelly |
| 5,108,963 | A | 4/1992 | Fu et al. |
| 5,114,438 | A | 5/1992 | Leatherman et al. |
| 5,120,327 | A | 6/1992 | Dennis |
| 5,123,935 | A | 6/1992 | Kanamaru et al. |
| 5,129,919 | A | 7/1992 | Kalinowski et al. |
| 5,131,926 | A | 7/1992 | Rostoker et al. |
| 5,132,984 | A | 7/1992 | Simpson |
| 5,139,978 | A | 8/1992 | Wood |
| 5,152,917 | A | 10/1992 | Pieper et al. |
| 5,160,509 | A | 11/1992 | Carman et al. |
| 5,164,744 | A | 11/1992 | Yoshida et al. |
| 5,173,457 | A | 12/1992 | Shorthouse |
| 5,178,849 | A | 1/1993 | Bauer |
| 5,180,630 | A | 1/1993 | Giglia |
| 5,185,012 | A | 2/1993 | Kelly |
| 5,185,299 | A | 2/1993 | Wood et al. |
| 5,190,568 | A | 3/1993 | Tselesin |
| 5,194,072 | A | 3/1993 | Rue et al. |
| 5,201,916 | A | 4/1993 | Berg et al. |
| 5,203,886 | A | 4/1993 | Sheldon et al. |
| 5,213,591 | A | 5/1993 | Celikkaya et al. |
| 5,215,552 | A | 6/1993 | Sung |
| 5,219,462 | A | 6/1993 | Bruxvoort et al. |
| 5,219,806 | A | 6/1993 | Wood |
| 5,221,294 | A | 6/1993 | Carman et al. |
| 5,224,970 | A | 7/1993 | Harakawa et al. |
| 5,227,104 | A | 7/1993 | Bauer |
| 5,244,477 | A | 9/1993 | Rue et al. |
| 5,244,849 | A | 9/1993 | Roy et al. |
| 5,273,558 | A | 12/1993 | Nelson et al. |
| 5,277,702 | A | 1/1994 | Thibault et al. |
| 5,282,875 | A | 2/1994 | Wood |
| 5,288,297 | A | 2/1994 | Ringwood |
| 5,300,130 | A | 4/1994 | Rostoker |
| 5,304,331 | A | 4/1994 | Leonard et al. |
| 5,312,789 | A | 5/1994 | Wood |
| 5,312,791 | A | 5/1994 | Coblenz et al. |
| 5,366,523 | A | 11/1994 | Rowenhorst et al. |
| 5,366,525 | A | 11/1994 | Fujiyama |
| 5,372,620 | A | 12/1994 | Rowse et al. |
| 5,373,786 | A | 12/1994 | Umaba |
| 5,376,598 | A | 12/1994 | Preedy et al. |
| 5,376,602 | A | 12/1994 | Nilsen |
| 5,383,945 | A | 1/1995 | Cottringer et al. |

(56) References Cited

U.S. PATENT DOCUMENTS 5,395,407 A 3/1995 Cottringer et al.
5,409,645 A 4/1995 Torre, Jr. et al.
5,429,648 A 7/1995 Wu
5,431,967 A 7/1995 Manthiram
5,435,816 A 7/1995 Spurgeon et al.
5,437,754 A 8/1995 Calhoun
5,441,549 A 8/1995 Helmin
5,443,603 A 8/1995 Kirkendall
5,447,894 A 9/1995 Yasuoka et al.
5,453,106 A 9/1995 Roberts
5,454,844 A 10/1995 Hibbard et al.
5,470,806 A 11/1995 Krstic et al.
5,478,642 A * 12/1995 McCord ..... 442/415
5,479,873 A 1/1996 Shintani et al.
5,482,756 A 1/1996 Berger et al.
5,486,496 A 1/1996 Talbert et al.
5,496,386 A 3/1996 Broberg et al.
5,500,273 A 3/1996 Holmes et al.
5,514,631 A 5/1996 Cottringer et al.
5,516,347 A 5/1996 Garg
5,516,348 A 5/1996 Conwell et al.
5,523,074 A 6/1996 Takahashi et al.
5,525,100 A 6/1996 Kelly et al.
5,527,369 A 6/1996 Garg
5,543,368 A 8/1996 Talbert et al.
5,551,963 A 9/1996 Larmie
5,560,745 A 10/1996 Roberts
5,567,150 A 10/1996 Conwell et al.
5,567,214 A 10/1996 Ashley
5,567,251 A 10/1996 Peker et al.
5,571,297 A 11/1996 Swei et al.
5,576,409 A 11/1996 Mackey
5,578,095 A 11/1996 Bland et al.
5,578,222 A 11/1996 Trischuk et al.
5,582,625 A 12/1996 Wright et al.
5,584,896 A 12/1996 Broberg et al.
5,584,897 A 12/1996 Christianson et al.
5,591,685 A 1/1997 Mitomo et al.
5,593,468 A 1/1997 Khaund et al.
5,599,493 A 2/1997 Ito et al.
5,609,706 A 3/1997 Benedict et al.
5,611,829 A 3/1997 Monroe et al.
5,618,221 A 4/1997 Furukawa et al.
5,628,952 A 5/1997 Holmes et al.
5,641,469 A 6/1997 Garg et al.
RE35,570 E 7/1997 Rowenhorst et al.
5,645,619 A 7/1997 Erickson et al.
5,651,925 A 7/1997 Ashley et al.
5,656,217 A 8/1997 Rogers et al.
5,667,542 A 9/1997 Law et al.
5,669,941 A 9/1997 Peterson
5,669,943 A 9/1997 Horton et al.
5,672,097 A 9/1997 Hoopman
5,672,554 A 9/1997 Mohri et al.
5,683,844 A 11/1997 Mammino
5,702,811 A 12/1997 Ho et al.
5,725,162 A 3/1998 Garg et al.
5,736,619 A 4/1998 Kane et al.
5,738,696 A 4/1998 Wu
5,738,697 A 4/1998 Wu et al.
5,751,313 A 5/1998 Miyashita et al.
5,759,481 A 6/1998 Pujari et al.
5,776,214 A 7/1998 Wood
5,779,743 A 7/1998 Wood
5,785,722 A 7/1998 Garg et al.
5,810,587 A 9/1998 Bruns et al.
5,820,450 A 10/1998 Calhoun
5,830,248 A 11/1998 Christianson et al.
5,840,089 A 11/1998 Chesley et al.
5,849,646 A 12/1998 Stout et al.
5,855,997 A 1/1999 Amateau
5,863,306 A 1/1999 Wei et al.
5,866,254 A 2/1999 Peker et al.
5,876,793 A 3/1999 Sherman et al.
5,885,311 A 3/1999 McCutcheon et al.
5,893,935 A 4/1999 Wood
5,902,647 A 5/1999 Venkataramani
5,908,477 A 6/1999 Harmer et al.
5,908,478 A 6/1999 Wood
5,919,549 A 7/1999 Van et al.
5,924,917 A 7/1999 Benedict et al.
5,946,991 A 9/1999 Hoopman
5,975,987 A 11/1999 Hoopman et al.
5,984,988 A 11/1999 Berg et al.
5,989,301 A 11/1999 Laconto, Sr. et al.
5,997,597 A 12/1999 Hagan
6,016,660 A 1/2000 Abramshe
6,019,805 A 2/2000 Herron
6,024,824 A 2/2000 Krech
6,027,326 A 2/2000 Cesarano, III et al.
6,048,577 A 4/2000 Garg
6,053,956 A 4/2000 Wood
6,054,093 A 4/2000 Torre, Jr. et al.
6,080,215 A 6/2000 Stubbs et al.
6,080,216 A 6/2000 Erickson
6,083,622 A 7/2000 Garg et al.
6,096,107 A 8/2000 Caracostas et al.
6,110,241 A 8/2000 Sung
6,129,540 A 10/2000 Hoopman et al.
6,136,288 A 10/2000 Bauer et al.
6,146,247 A 11/2000 Nokubi et al.
6,179,887 B1 1/2001 Barber, Jr. et al.
6,206,942 B1 3/2001 Wood
6,228,134 B1 5/2001 Erickson
6,238,450 B1 5/2001 Garg et al.
6,258,137 B1 7/2001 Garg et al.
6,258,141 B1 7/2001 Sung et al.
6,261,682 B1 7/2001 Law
6,264,710 B1 7/2001 Erickson
6,277,160 B1 8/2001 Stubbs et al.
6,277,161 B1 8/2001 Castro et al.
6,283,997 B1 9/2001 Garg et al.
6,284,690 B1 9/2001 Nakahata et al.
6,287,353 B1 9/2001 Celikkaya
6,306,007 B1 10/2001 Mori et al.
6,312,324 B1 11/2001 Mitsui et al.
6,319,108 B1 11/2001 Adefris et al.
6,331,343 B1 12/2001 Perez et al.
6,371,842 B1 4/2002 Romero
6,391,812 B1 5/2002 Araki et al.
6,401,795 B1 6/2002 Cesarano, III et al.
6,403,001 B1 6/2002 Hayashi
6,413,286 B1 7/2002 Swei et al.
6,451,076 B1 9/2002 Nevoret et al.
6,475,253 B2 11/2002 Culler et al.
6,524,681 B1 2/2003 Seitz et al.
6,531,423 B1 3/2003 Schwetz et al.
6,537,140 B1 3/2003 Miller et al.
6,579,819 B2 6/2003 Hirosaki et al.
6,582,623 B1 6/2003 Grumbine et al.
6,583,080 B1 6/2003 Rosenflanz
6,599,177 B2 7/2003 Nevoret et al.
6,646,019 B2 11/2003 Perez et al.
6,652,361 B1 11/2003 Gash et al.
6,669,745 B2 12/2003 Prichard et al.
6,685,755 B2 2/2004 Ramanath et al.
6,696,258 B1 2/2004 Wei
6,702,650 B2 3/2004 Adefris
6,737,378 B2 5/2004 Hirosaki et al.
6,749,496 B2 6/2004 Mota et al.
6,755,729 B2 6/2004 Ramanath et al.
6,833,014 B2 12/2004 Welygan et al.
6,843,815 B1 1/2005 Thurber et al.
6,878,456 B2 4/2005 Castro et al.
6,881,483 B2 4/2005 McArdle et al.
6,888,360 B1 5/2005 Connell et al.
6,913,824 B2 7/2005 Culler et al.
6,942,561 B2 9/2005 Mota et al.
6,949,128 B2 9/2005 Annen
6,974,930 B2 12/2005 Jense
7,022,179 B1 4/2006 Dry
7,044,989 B2 5/2006 Welygan et al.
7,141,522 B2 11/2006 Rosenflanz et al.
7,168,267 B2 1/2007 Rosenflanz et al.

(56) References Cited

U.S. PATENT DOCUMENTS

| | | | |
|---|---|---|---|
| 7,169,198 | B2 | 1/2007 | Moeltgen et al. |
| 7,267,700 | B2 | 9/2007 | Collins et al. |
| 7,294,158 | B2 | 11/2007 | Welygan et al. |
| 7,297,170 | B2 | 11/2007 | Welygan et al. |
| 7,297,402 | B2 | 11/2007 | Evans et al. |
| 7,364,788 | B2 | 4/2008 | Kishbaugh et al. |
| 7,373,887 | B2 | 5/2008 | Jackson |
| 7,384,437 | B2 | 6/2008 | Welygan et al. |
| 7,488,544 | B2 | 2/2009 | Schofalvi et al. |
| 7,507,268 | B2 | 3/2009 | Rosenflanz |
| 7,553,346 | B2 | 6/2009 | Welygan et al. |
| 7,556,558 | B2 | 7/2009 | Palmgren |
| 7,560,062 | B2 | 7/2009 | Gould et al. |
| 7,560,139 | B2 | 7/2009 | Thebault et al. |
| 7,563,293 | B2 | 7/2009 | Rosenflanz |
| 7,611,795 | B2 | 11/2009 | Aoyama et al. |
| 7,618,684 | B2 | 11/2009 | Nesbitt |
| 7,662,735 | B2 | 2/2010 | Rosenflanz et al. |
| 7,666,344 | B2 | 2/2010 | Schofalvi et al. |
| 7,666,475 | B2 | 2/2010 | Morrison |
| 7,669,658 | B2 | 3/2010 | Barron et al. |
| 7,670,679 | B2 | 3/2010 | Krishna et al. |
| 7,695,542 | B2 | 4/2010 | Drivdahl et al. |
| 7,858,189 | B2 | 12/2010 | Wagener et al. |
| 7,906,057 | B2 | 3/2011 | Zhang et al. |
| 7,968,147 | B2 | 6/2011 | Fang et al. |
| 7,972,430 | B2 | 7/2011 | Millard et al. |
| 8,021,449 | B2 | 9/2011 | Seth et al. |
| 8,034,137 | B2 | 10/2011 | Erickson et al. |
| 8,049,136 | B2 | 11/2011 | Mase et al. |
| 8,070,556 | B2 | 12/2011 | Kumar et al. |
| 8,123,828 | B2 | 2/2012 | Culler et al. |
| 8,141,484 | B2 | 3/2012 | Ojima et al. |
| 8,142,531 | B2 | 3/2012 | Adefris et al. |
| 8,142,532 | B2 | 3/2012 | Erickson et al. |
| 8,142,891 | B2 | 3/2012 | Culler et al. |
| 8,256,091 | B2 | 9/2012 | Duescher |
| 8,480,772 | B2 | 7/2013 | Welygan et al. |
| 8,628,597 | B2 | 1/2014 | Palmgren et al. |
| 8,783,589 | B2 | 7/2014 | Hart et al. |
| 2001/0027623 | A1 | 10/2001 | Rosenflanz |
| 2002/0026752 | A1 | 3/2002 | Culler et al. |
| 2002/0151265 | A1 | 10/2002 | Adefris |
| 2002/0170236 | A1 | 11/2002 | Larson et al. |
| 2002/0174935 | A1 | 11/2002 | Burdon et al. |
| 2002/0177391 | A1 | 11/2002 | Fritz et al. |
| 2003/0008933 | A1 | 1/2003 | Perez et al. |
| 2003/0022961 | A1 | 1/2003 | Kusaka et al. |
| 2003/0029094 | A1 | 2/2003 | Moeltgen et al. |
| 2003/0085204 | A1 | 5/2003 | Lagos |
| 2003/0109371 | A1 | 6/2003 | Pujari et al. |
| 2003/0110707 | A1 | 6/2003 | Rosenflanz et al. |
| 2003/0126800 | A1 | 7/2003 | Seth et al. |
| 2004/0003895 | A1 | 1/2004 | Amano et al. |
| 2004/0148967 | A1 | 8/2004 | Celikkaya et al. |
| 2004/0202844 | A1 | 10/2004 | Wong |
| 2004/0224125 | A1 | 11/2004 | Yamada et al. |
| 2004/0235406 | A1 | 11/2004 | Duescher |
| 2004/0244675 | A1 | 12/2004 | Kishimoto et al. |
| 2005/0020190 | A1 | 1/2005 | Schutz et al. |
| 2005/0060941 | A1 | 3/2005 | Provow et al. |
| 2005/0060947 | A1 | 3/2005 | McArdle et al. |
| 2005/0064805 | A1 | 3/2005 | Culler et al. |
| 2005/0081455 | A1 | 4/2005 | Welygan et al. |
| 2005/0118939 | A1 | 6/2005 | Duescher |
| 2005/0132655 | A1 | 6/2005 | Anderson et al. |
| 2005/0218565 | A1 | 10/2005 | DiChiara, Jr. |
| 2005/0223649 | A1 | 10/2005 | O'Gary et al. |
| 2005/0232853 | A1 | 10/2005 | Evans et al. |
| 2005/0245179 | A1 | 11/2005 | Luedeke |
| 2005/0255801 | A1 | 11/2005 | Pollasky |
| 2005/0266221 | A1 | 12/2005 | Karam et al. |
| 2005/0271795 | A1 | 12/2005 | Moini et al. |
| 2005/0284029 | A1 | 12/2005 | Bourlier et al. |
| 2006/0049540 | A1 | 3/2006 | Hui et al. |
| 2006/0126265 | A1 | 6/2006 | Crespi et al. |
| 2006/0135050 | A1 | 6/2006 | Petersen et al. |
| 2006/0185256 | A1 | 8/2006 | Nevoret et al. |
| 2007/0020457 | A1 | 1/2007 | Adefris |
| 2007/0051355 | A1 | 3/2007 | Sung |
| 2007/0072527 | A1 | 3/2007 | Palmgren |
| 2007/0074456 | A1 | 4/2007 | Orlhac et al. |
| 2007/0087928 | A1 | 4/2007 | Rosenflanz et al. |
| 2007/0234646 | A1 | 10/2007 | Can et al. |
| 2008/0017053 | A1 | 1/2008 | Araumi et al. |
| 2008/0072500 | A1* | 3/2008 | Klett et al. ..... 51/295 |
| 2008/0092455 | A1* | 4/2008 | You ..... 51/298 |
| 2008/0121124 | A1 | 5/2008 | Sato |
| 2008/0172951 | A1 | 7/2008 | Starling |
| 2008/0176075 | A1 | 7/2008 | Bauer et al. |
| 2008/0179783 | A1 | 7/2008 | Liu et al. |
| 2008/0230951 | A1 | 9/2008 | Dannoux et al. |
| 2008/0262577 | A1 | 10/2008 | Altshuler et al. |
| 2008/0286590 | A1 | 11/2008 | Besida et al. |
| 2008/0299875 | A1 | 12/2008 | Duescher |
| 2009/0016916 | A1 | 1/2009 | Rosenzweig et al. |
| 2009/0017736 | A1 | 1/2009 | Block et al. |
| 2009/0165394 | A1 | 7/2009 | Culler et al. |
| 2009/0165661 | A1 | 7/2009 | Koenig et al. |
| 2009/0208734 | A1 | 8/2009 | Macfie et al. |
| 2009/0246464 | A1 | 10/2009 | Watanabe et al. |
| 2010/0000159 | A1 | 1/2010 | Walia et al. |
| 2010/0003900 | A1 | 1/2010 | Sakaguchi et al. |
| 2010/0003904 | A1 | 1/2010 | Duescher |
| 2010/0056816 | A1 | 3/2010 | Wallin et al. |
| 2010/0068974 | A1 | 3/2010 | Dumm et al. |
| 2010/0146867 | A1 | 6/2010 | Boden et al. |
| 2010/0151195 | A1 | 6/2010 | Culler et al. |
| 2010/0151196 | A1 | 6/2010 | Adefris et al. |
| 2010/0151201 | A1 | 6/2010 | Erickson et al. |
| 2010/0190424 | A1 | 7/2010 | Francois et al. |
| 2010/0201018 | A1 | 8/2010 | Yoshioka et al. |
| 2010/0292428 | A1 | 11/2010 | Meador et al. |
| 2010/0307067 | A1 | 12/2010 | Sigalas et al. |
| 2010/0319269 | A1 | 12/2010 | Erickson |
| 2011/0008604 | A1 | 1/2011 | Boylan |
| 2011/0111563 | A1 | 5/2011 | Yanagi et al. |
| 2011/0124483 | A1 | 5/2011 | Shah et al. |
| 2011/0136659 | A1 | 6/2011 | Allen et al. |
| 2011/0146509 | A1 | 6/2011 | Welygan et al. |
| 2011/0160104 | A1 | 6/2011 | Wu et al. |
| 2011/0244769 | A1 | 10/2011 | David et al. |
| 2011/0289854 | A1 | 12/2011 | Moren et al. |
| 2011/0314746 | A1 | 12/2011 | Erickson et al. |
| 2012/0000135 | A1 | 1/2012 | Eilers et al. |
| 2012/0137597 | A1 | 6/2012 | Adefris et al. |
| 2012/0144754 | A1 | 6/2012 | Culler et al. |
| 2012/0144755 | A1 | 6/2012 | Erickson et al. |
| 2012/0153547 | A1 | 6/2012 | Bauer et al. |
| 2012/0167481 | A1 | 7/2012 | Yener et al. |
| 2012/0168979 | A1 | 7/2012 | Bauer et al. |
| 2012/0227333 | A1 | 9/2012 | Adefris et al. |
| 2012/0231711 | A1 | 9/2012 | Keipert et al. |
| 2013/0000212 | A1 | 1/2013 | Wang et al. |
| 2013/0000216 | A1 | 1/2013 | Wang et al. |
| 2013/0009484 | A1 | 1/2013 | Yu |
| 2013/0036402 | A1 | 2/2013 | Mutisya et al. |
| 2013/0045251 | A1 | 2/2013 | Cen et al. |
| 2013/0074418 | A1 | 3/2013 | Panzarella et al. |
| 2013/0125477 | A1 | 5/2013 | Adefris |
| 2013/0180180 | A1 | 7/2013 | Yener et al. |
| 2013/0186005 | A1 | 7/2013 | Kavanaugh |
| 2013/0186006 | A1 | 7/2013 | Kavanaugh et al. |
| 2013/0199105 | A1 | 8/2013 | Braun et al. |
| 2013/0236725 | A1 | 9/2013 | Yener et al. |
| 2013/0255162 | A1 | 10/2013 | Welygan et al. |
| 2013/0267150 | A1 | 10/2013 | Seider et al. |
| 2013/0283705 | A1 | 10/2013 | Fischer et al. |
| 2013/0305614 | A1 | 11/2013 | Gaeta et al. |
| 2013/0337262 | A1 | 12/2013 | Bauer et al. |
| 2013/0337725 | A1 | 12/2013 | Monroe |
| 2014/0000176 | A1 | 1/2014 | Moren et al. |
| 2014/0007518 | A1 | 1/2014 | Yener et al. |
| 2014/0080393 | A1 | 3/2014 | Ludwig |

(56) References Cited

U.S. PATENT DOCUMENTS

| | | | |
|---|---|---|---|
| 2014/0106126 | A1 | 4/2014 | Gaeta et al. |
| 2014/0182216 | A1 | 7/2014 | Panzarella et al. |
| 2014/0182217 | A1 | 7/2014 | Yener et al. |
| 2014/0186585 | A1 | 7/2014 | Field, Ill et al. |
| 2014/0250797 | A1 | 9/2014 | Yener et al. |
| 2014/0290147 | A1 | 10/2014 | Seth et al. |
| 2014/0378036 | A1 | 12/2014 | Cichowlas et al. |
| 2015/0000209 | A1 | 1/2015 | Louapre et al. |
| 2015/0000210 | A1 | 1/2015 | Breder et al. |
| 2015/0089881 | A1 | 4/2015 | Stevenson et al. |
| 2015/0126098 | A1 | 5/2015 | Eilers et al. |
| 2015/0128505 | A1 | 5/2015 | Wang et al. |
| 2015/0232727 | A1 | 8/2015 | Erickson |

FOREIGN PATENT DOCUMENTS

| | | | |
|---|---|---|---|
| DE | 102012023688 | A1 | 4/2014 |
| DE | 202014101739 | U1 | 6/2014 |
| DE | 202014101741 | U1 | 6/2014 |
| DE | 102013202204 | A1 | 8/2014 |
| EP | 0078896 | A2 | 5/1983 |
| EP | 0152768 | A3 | 9/1987 |
| EP | 0293163 | A2 | 11/1988 |
| EP | 0480133 | A2 | 4/1992 |
| EP | 0652919 | A1 | 5/1995 |
| EP | 0662110 | A1 | 7/1995 |
| EP | 0500369 | B1 | 1/1996 |
| EP | 0609864 | B1 | 11/1996 |
| EP | 0771769 | | 5/1997 |
| EP | 0812456 | B1 | 12/1997 |
| EP | 0651778 | B1 | 5/1998 |
| EP | 0614861 | B1 | 5/2001 |
| EP | 0931032 | B1 | 7/2001 |
| EP | 0833803 | | 8/2001 |
| EP | 1371451 | A1 | 12/2003 |
| EP | 1383631 | B1 | 1/2004 |
| EP | 1015181 | B1 | 3/2004 |
| EP | 1492845 | A1 | 1/2005 |
| EP | 1851007 | A1 | 11/2007 |
| EP | 1960157 | A1 | 8/2008 |
| EP | 2176031 | A1 | 4/2010 |
| EP | 2184134 | A1 | 5/2010 |
| EP | 2390056 | A2 | 11/2011 |
| EP | 1800801 | B1 | 3/2012 |
| EP | 2567784 | A1 | 3/2013 |
| EP | 2692813 | A1 | 2/2014 |
| EP | 2692814 | A1 | 2/2014 |
| EP | 2692815 | A1 | 2/2014 |
| EP | 2692816 | A1 | 2/2014 |
| EP | 2692817 | A1 | 2/2014 |
| EP | 2692818 | A1 | 2/2014 |
| EP | 2692819 | A1 | 2/2014 |
| EP | 2692820 | A1 | 2/2014 |
| EP | 2692821 | A1 | 2/2014 |
| FR | 2354373 | A1 | 1/1978 |
| GB | 986847 | A | 3/1965 |
| JP | 53064890 | A | 6/1978 |
| JP | 60-006356 | U | 1/1985 |
| JP | 62002946 | B | 1/1987 |
| JP | 63036905 | B | 7/1988 |
| JP | 3079277 | A | 4/1991 |
| JP | 03-287687 | | 12/1991 |
| JP | 5285833 | A | 11/1993 |
| JP | 6114739 | A | 4/1994 |
| JP | 7008474 | B2 | 2/1995 |
| JP | 10113875 | A | 5/1998 |
| JP | 2779252 | B2 | 7/1998 |
| JP | 10-315142 | A | 12/1998 |
| JP | 10330734 | A | 12/1998 |
| JP | 2957492 | B2 | 10/1999 |
| JP | 2000091280 | A | 3/2000 |
| JP | 2000-336344 | A | 12/2000 |
| JP | 3160084 | B2 | 4/2001 |
| JP | 2001162541 | A | 6/2001 |
| JP | 03194269 | B2 | 7/2001 |
| JP | 2001207160 | A | 7/2001 |
| JP | 2002-038131 | A | 2/2002 |
| JP | 2003-049158 | A | 2/2003 |
| JP | 2004-510873 | A | 4/2004 |
| JP | 2004209624 | A | 7/2004 |
| JP | 2006159402 | A | 6/2006 |
| JP | 2006-192540 | A | 7/2006 |
| JP | 2008194761 | A | 8/2008 |
| NL | 171464 | B | 11/1982 |
| WO | 9402559 | A1 | 2/1994 |
| WO | 95/03370 | | 2/1995 |
| WO | 95/18192 | A1 | 7/1995 |
| WO | 9520469 | A1 | 8/1995 |
| WO | 96/27189 | A1 | 9/1996 |
| WO | 9714536 | A1 | 4/1997 |
| WO | 9906500 | A1 | 2/1999 |
| WO | 99/38817 | A1 | 8/1999 |
| WO | 9938817 | A1 | 8/1999 |
| WO | 9954424 | A1 | 10/1999 |
| WO | 01/14494 | A1 | 3/2001 |
| WO | 02097150 | | 12/2002 |
| WO | 03/087236 | A1 | 10/2003 |
| WO | 2005/080624 | A1 | 9/2005 |
| WO | 2006/027593 | | 3/2006 |
| WO | 2007/041538 | A1 | 4/2007 |
| WO | 2009085578 | A2 | 7/2009 |
| WO | 2010/077509 | A1 | 7/2010 |
| WO | 2010085587 | A1 | 7/2010 |
| WO | 2010/151201 | | 12/2010 |
| WO | 2011/068724 | A2 | 6/2011 |
| WO | 2011068714 | A2 | 6/2011 |
| WO | 2011087649 | A2 | 7/2011 |
| WO | 2011/109188 | A2 | 9/2011 |
| WO | 2011/139562 | A2 | 11/2011 |
| WO | 2011/149625 | A2 | 12/2011 |
| WO | 2012/018903 | A2 | 2/2012 |
| WO | 2012/061016 | A1 | 5/2012 |
| WO | 2012/061033 | A2 | 5/2012 |
| WO | 2012/092590 | A2 | 7/2012 |
| WO | 2012/092605 | A2 | 7/2012 |
| WO | 2012/112305 | A2 | 8/2012 |
| WO | 2012/112322 | A2 | 8/2012 |
| WO | 2012/141905 | A2 | 10/2012 |
| WO | 2013/003830 | A2 | 1/2013 |
| WO | 2013/003831 | A2 | 1/2013 |
| WO | 2013/009484 | A2 | 1/2013 |
| WO | 2013/036402 | A1 | 3/2013 |
| WO | 2013/045251 | A1 | 4/2013 |
| WO | 2013/049239 | A1 | 4/2013 |
| WO | 2013070576 | A2 | 5/2013 |
| WO | 2013/102170 | A1 | 7/2013 |
| WO | 2013/102176 | A1 | 7/2013 |
| WO | 2013/102177 | A1 | 7/2013 |
| WO | 2013/106597 | A1 | 7/2013 |
| WO | 2013/106602 | A1 | 7/2013 |
| WO | 2013/149209 | A1 | 10/2013 |
| WO | 2013/151745 | A1 | 10/2013 |
| WO | 2013/177446 | A1 | 11/2013 |
| WO | 2013/188038 | A1 | 12/2013 |
| WO | 2014/005120 | A1 | 1/2014 |
| WO | 2014/161001 | A1 | 2/2014 |
| WO | 2014020068 | A1 | 2/2014 |
| WO | 2014020075 | A1 | 2/2014 |
| WO | 2014022453 | A1 | 2/2014 |
| WO | 2014022462 | A1 | 2/2014 |
| WO | 2014022465 | A1 | 2/2014 |
| WO | 2014/062701 | A1 | 4/2014 |
| WO | 2014/070468 | A1 | 5/2014 |
| WO | 2014/106173 | A1 | 7/2014 |
| WO | 2014/106211 | A1 | 7/2014 |
| WO | 2014/124554 | A1 | 8/2014 |
| WO | 2014/137972 | A1 | 9/2014 |
| WO | 2014/140689 | A1 | 9/2014 |
| WO | 2014/165390 | A1 | 10/2014 |
| WO | 20141176108 | A1 | 10/2014 |
| WO | 2014/209567 | A1 | 12/2014 |
| WO | 2014/210160 | A1 | 12/2014 |
| WO | 2014/210442 | A1 | 12/2014 |

(56) References Cited

FOREIGN PATENT DOCUMENTS

| | | | |
|---|---|---|---|
| WO | 2014/210532 | A1 | 12/2014 |
| WO | 2014/210568 | A1 | 12/2014 |
| WO | 2015/073346 | A1 | 5/2015 |
| WO | 2015/088953 | A1 | 6/2015 |
| WO | 2015/089528 | A1 | 6/2015 |
| WO | 2015/100018 | A1 | 7/2015 |
| WO | 2015/100020 | A1 | 7/2015 |
| WO | 2015/100220 | A1 | 7/2015 |
| WO | 2015/130487 | A1 | 9/2015 |

OTHER PUBLICATIONS

"Investigation of Shaped Abrasive Particles vol. 1: Review of U.S. Pat. No. 6,054,093 Apr. 25, 2000" © Apr. 2011, 5 pages.
Austin, Benson M., "Thick-Film Screen Printing," Solid State Technology, Jun. 1969, pp. 53-58.
Avril, Nicholas Joseph, "Manufacturing Glass-fiber Reinforcement for Grinding Wheels," Massachusetts Institute of Technology, 1996, 105 pgs.
Bacher, Rudolph J., "High Resolution Thick Film Printing," E.I. du Pont de Nemours & Company, Inc., pp. 576-581, date unknown.
Besse, John R., "Understanding and controlling wheel truing and dressing forces when rotary plunge dressing," Cutting Tool Engineering, Jun. 2012, vol. 64, Issue 6, 5 pages.
Brewer, L. et al., Journal of Materials Research, 1999, vol. 14, No. 10, pp. 3907-3912.
Ciccotti, M. et al., "Complex dynamics in the peeling of an adhesive tape," International Journal of Adhesion & Adhesives 24 (2004) pp. 143-151.
Dupont, "Kevlar Aramid Pulp", Copyright 2011, DuPont, 1 page.
Wu, J. et al., Friction and Wear Properties of Kevlar Pulp Reinforced Epoxy.
J. European Ceramic Society 31, Abstract only (2011) 2073-2081.
Riemer, Dietrich E., "Analytical Engineering Model of the Screen Printing Process: Part II," Solid State Technology, Sep. 1988, pp. 85-90.
Miller, L.F., "Paste Transfer in the Screening Process," Solid State Technology, Jun. 1969, pp. 46-52.
Morgan, P. et al., "Ceramic Composites of Monazite and Alumina," J. Am. Ceram. Soc., 78, 1995, 1553-63.
Riemer, Dietrich E., "Analytical Engineering Model of the Screen Printing Process: Part I," Solid State Technology, Aug. 1988, pp. 107-111.
Winter Catalogue No. 5, Dressing tools, Winter diamond tools for dressing grinding wheels, 140 pages.
Badger, Jeffrey, "Evaluation of Triangular, Engineered-Shape Ceramic Abrasive in Cutting Discs," Supplement to the Welding Journal, Apr. 2014, vol. 93, pp. 107-s to 115-s.
PCT/US2013/034717, International Search Report mailed Jul. 9, 2013, 1 page.
3M Cubitron II Abrasive Belts Brochure, Shaping the Future, Jan. 2011, 6 pages.
Vanstrum et al., Precisely Shaped Grain (PSG): 3M's Innovation in Abrasive Grain Technology, date unknown, 1 page.
Graf, "Cubitron II: Precision-Shaped Grain (PSG) Turns the Concept of Gear Grinding Upside Down," gearsolutions.com, May 2014, pp. 36-44.
Dow Machine Tool Accessories, Grinding & Surface Finishing, www.1mta.com, Nov. 2014, 72 pages.
A. Hashimoto et al., "Fibrillation of aramid fiber using a vibrating ball mill and evluation of the degree of fibrillation," Journal of Materials Science 37 (2002) Kluwer Academic Publishers, pp. 4013-4017.

* cited by examiner

Control 0.3 wt. %

0.5 wt. %

0.7 wt. %

1.5 wt. %

ABRASIVE PRODUCTS HAVING FIBRILLATED FIBERS

CROSS-REFERENCE TO RELATED APPLICATION(S)

The present application claims priority from U.S. Provisional Patent Application No. 61/618,007, filed Mar. 30, 2012, entitled "ABRASIVE PRODUCTS HAVING FIBRILLATED FIBERS," naming inventors Anthony Gaeta, Anuj Seth, Charles Herbert, Darrell Everts, Frank Csillag, Julienne Labrecque and Kamran Khatami, which application is incorporated by reference herein in its entirety.

BACKGROUND

1. Field of the Disclosure

The present disclosure is generally directed to coated abrasive products containing fibrillated fibers dispersed within one or more polymeric coatings, methods related to the retention and orientation control of abrasive grains, and methods related to the finishing of surfaces including natural and synthetic substrates, such as metal, ceramic, wood, polymeric, glass, and stone.

2. Description of the Related Art

Abrasive products, such as coated abrasive products, are used in various industries to abrade work pieces, such as by sanding, lapping, grinding, polishing or other mechanical surface material removal processes. Surface processing using coated abrasives spans a wide industrial and consumer scope from optics industries to metal fabrication industries. Effective and efficient abrasion of surfaces, particularly metal, glass, ceramic, stone, and coated surfaces poses numerous challenges.

Material removal can be affected by the durability of the abrasive product. Abrasive products that wear easily or lose abrasive grains can exhibit both a low material removal rate and can cause surface defects. Rapid wear on the abrasive product can lead to a reduction in material removal rate and reduction in cumulative material removal, resulting in time lost for frequent exchanging of the abrasive product and increased waste associated with discarded abrasive product.

In addition, industries are sensitive to costs related to abrasive material removal operations. Factors influencing operational costs include the speed at which a surface can be prepared and the cost of the materials used to prepare that surface. Typically, industry seeks cost effective materials having high material removal rates and high cumulative material removal per product. Therefore, abrasives that need often replacement result in increased time, effort, and an overall increase in total processing costs.

Abrasive products such as sanding belts undergo severe operational stresses during surface processing. Due to deficiencies in traditional abrasive product structures and processes of manufacture, these stresses can cause early failure of the traditional abrasive products through, for example, separation of their various layers and crack propagation that leads to ineffectual abrasive grain orientation and eventual loss of the abrasive grains. Moreover, such abrasive products have been traditionally produced without sufficient control over the orientation of the abrasive grains, without sufficient ability to retain the abrasive grains on the abrasive product, and without sufficient ability to maintain the abrasive grains in a desirable orientation for grinding. Such deficiencies not only increase overall costs, but decrease grinding efficiency.

There continues to be a demand for improved, cost effective, abrasive products, processes, and systems that promote efficient and effective abrasion. It is therefore desirable to enjoy an abrasive product with increased inter-layer adhesion and abrasive grain retention. It is further desirable to enjoy an abrasive product with an increased ability to maintain abrasive grains in a desirable orientation.

GENERAL DESCRIPTION OF THE EMBODIMENTS

Embodiments of the present invention are generally related to an engineered coated abrasive product having a backing and one or more polymeric formulations disposed on the backing, wherein the polymeric formulation includes fibrillated fibers. The polymeric formulations may be used to form various layers of the coated abrasive such as, for example, a frontfill coat, a make coat, and/or a size coat of the coated abrasives according to embodiments of the present invention. In particular, embodiments of polymeric formulations of the present invention include fibrillated fibers including aramid pulp, such as poly-paraphenylene terephthalamide pulp (e.g., Kevlar® pulp).

Embodiments of the present invention may also include abrasive grains disposed on one or more of the coats (e.g., frontfill coat, make coat, size coat) of the coated abrasive product. The coated abrasive product is capable of improved inter-layer adhesion, retention of abrasive grains, and/or maintenance of abrasive grains in a more desirable orientation for grinding at least partially due to the included fibrillated fibers.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings may indicate similar or identical items.

DETAILED DESCRIPTION OF THE EMBODIMENT(S)

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present). The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the engineered abrasive arts.

At least one embodiment of the present invention is a component of a coated abrasive article. In such an embodiment, a component is a modified backing material, and generally includes a backing material and a polymer formulation, wherein the polymer formulation includes a plurality of fibrillated fibers dispersed within and/or throughout the polymeric formulation. The term "fibrillated fiber" as used herein generally describes fibers that have been processed to develop a branched structure and, therefore, a higher surface area than fibers without a branched structure. The terms "abrasive article" or "abrasive product" are interchangeable as used herein, and generally refer to an article that contains abrasive grains and one or more layers for supporting the abrasive grains, such as, for example, a sanding or grinding belt.

Figure 1:
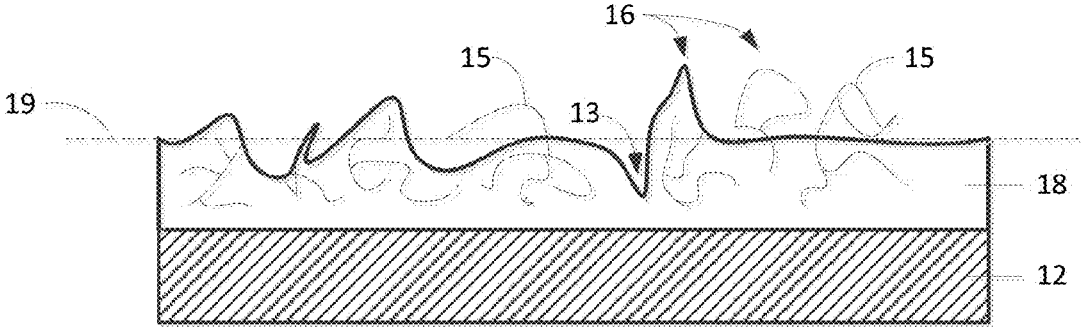
FIG. 1 is an illustration of a cross-section of an embodiment of a modified backing.

Referring now to the figures, in one embodiment of the abrasive article of the present invention shown in FIG. 1, the abrasive article includes a backing (or substrate) 12 and a frontfill 18 having a plurality of fibrillated fibers 15. As discussed further herein, the backing 12 may be made of any of a number of backing materials known in the art, including cloth and paper, as discussed further herein. As also discussed further herein, the frontfill may be made of any number of polymer formulations known in the art, but generally include phenolic resin, phenolic-latex resin, epoxy resin, polyester resin or urea formaldehyde resin.

Backing materials include any flexible web such as, for example, polymeric film, paper, cloth (including woven, non-woven, or fleeced fabric), metallic film, vulcanized fiber, non-woven substrates, any combinations of the foregoing, and treated versions of the foregoing materials. In an embodiment, the backing comprises a polymeric film, such as a film of polyester, polyurethane, polypropylene, polyimides such as KAPTON from DuPont. In another embodiment, the backing comprises a polyester fabric or cloth. In yet another embodiment, the backing comprises Monadnock paper. Films can be primed to promote adhesion of the abrasive aggregates to the backing. The backing can be laminated to another substrate for strength, support, or dimensional stability. Lamination can be accomplished before or after the abrasive article is formed. The abrasive article can be in the form of an endless belt, a disk, a sheet, or a flexible tape that is sized so as to be capable of being brought into contact with a workpiece.

The polymer formulation may be used to form any of a variety of layers of the abrasive article such as, for example, the frontfill, the pre-size coat, the make coat, the size coat, and/or the supersize coat. When used to form the frontfill, the polymer formulation generally includes a polymer resin, fibrillated fibers (preferably in the form of pulp), filler material, and other optional additives. Suitable polymeric formulations for some frontfill embodiments (and embodiments of other layers) of the present invention are shown in TABLE 1 below.

TABLE 1

| Frontfill Control/General | |
|---|---|
| Component | Wt. % |
| TRM1190 Resin | 52.79% |
| Defoamer TRM1161 | 0.11% |
| Witcona TRM0240 | 0.11% |
| Wollastonite TRM0013 | 42.93% |
| Water | 4.06% |
| Pre-opened Kevlar ® Pulp | 0.0% |
| Total: | 100% |

For example, a phenolic resin formulation such as such as that shown above in TABLE 1 is a preferred general frontfill polymer formulation not yet including the added fibrillated fibers in percentages discussed below. As shown above in TABLE 1, the general formulation of a phenolic resin suitable for a frontfill of some embodiments of the present invention typically includes phenolic resin (about 52 wt %), wollastonite filler, (about 42 wt %), defoamer (about 0.11 wt %), witcona surfactant (about 0.11 wt %), and a balance of water (about 4 wt %). As described in the Examples further herein, such a formulation as that of TABLE 1 without fibrillated fibers is used as a control mix. In wet form, the thickness of the frontfill is between 3 mil and 15 mil, more preferably between 8 mil to 10 mil (where 1 mil=0.0254 mm, or 25.4 μm).

Suitable polymeric resin materials include curable resins selected from thermally curable resins including phenolic resins, urea/formaldehyde resins, phenolic/latex resins, as well as combinations of such resins. Other suitable polymeric resin materials may also include radiation curable resins, such as those resins curable using electron beam, UV radiation, or visible light, such as epoxy resins, acrylated oligomers of acrylated epoxy resins, polyester resins, acrylated urethanes and polyester acrylates and acrylated monomers including monoacrylated, multiacrylated monomers.

The polymeric formulation of the present invention may be generally made of any number of polymer resins known in the art, but generally includes phenolic resin, phenolic/latex resin, or urea/formaldehyde resin. In some preferred embodiments, the polymer resin for the frontfill includes phenolic resin in the range of between 37 wt % to 67 wt %, such as in the range of between 42 wt. % to 62 wt %, such as in the range of between 47 wt % to 56 wt %, such as about 52.79 wt %.

The polymeric formulation can also comprise a nonreactive thermoplastic resin binder which can enhance the self-sharpening characteristics of the deposited abrasive composites by enhancing the erodability. Examples of such thermoplastic resin include polypropylene glycol, polyethylene glycol, and polyoxypropylene-polyoxyethene block copolymer, etc.

The present invention provides for fibrillated fibers to be dispersed within and/or throughout at least one of the polymer formulations used to form the abrasive article. In at least one embodiment of the present invention, fibrillated fibers considered suitable include natural, synthetic, organic, inorganic, polymeric, aramid, poly-aramid, polypropylene, acrylic, and cellulose fibrillated fibers. Particularly, the fibrillated fibers for use in the present invention are preferably between about 0.5-1.0 mm in length and between about 0.015-1.0 mm in diameter. Fibrillated fibers of the present invention are not to be confused with smooth, long, reinforcing filaments.

A preferred fibrillated fiber for use with the present invention has a specific gravity of about 1.45g/cc, a bulk density of 0.0481-0.112 g/cc (0.00174-0.0045 lb/in$^3$), and a specific surface area of 7.00-11.0 m$^2$/g). The thermal properties of a preferred fibrillated fiber include a maximum service temperature of about 350° C. (662° F.) and a minimum service temperature of about −200° C. (−328° F.). One such fibrillated fiber is aramid pulp, such as poly-paraphenylene terephthalamide pulp (e.g., Kevlar® pulp), which can be obtained from DuPont. Kevlar® pulp is available in different forms, original, 50% wet, and pre-opened, some more suitable in the present invention than others. Example 1 discussed below investigates these three forms of Kevlar® pulp as to which form(s) provide best results in an abrasive article of the present invention. In at least one embodiment of the present invention, pre-opened Kevlar® pulp is considered preferred. In at least another embodiment, original Kevlar® pulp is preferred. In any case, Kevlar® pulp is included in a polymeric formulation in the ranges of between 0.1 wt % to 3 wt %, such as between 0.3 wt % to 2 wt %, such as between 0.5 wt % and 1.5 wt %. In at least one embodiment, 0.7 wt % Kevlar® pulp is preferred.

Figure 7A:
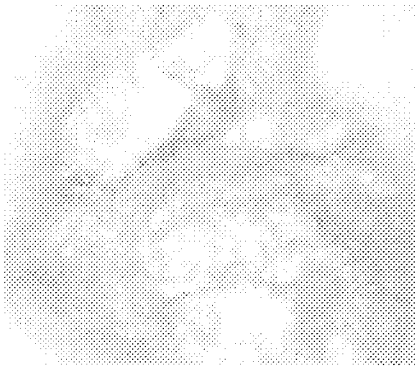
FIG. 7A is a photograph of original Kevlar® pulp.
Figure 7B:
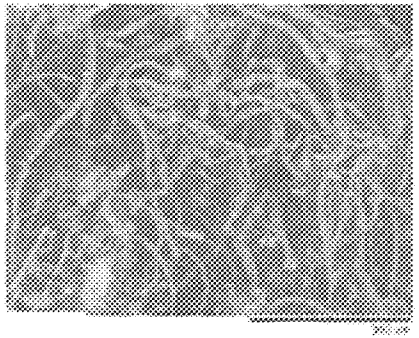
FIG. 7B is an SEM image of the original Kevlar® pulp of FIG. 7A.

Original form Kevlar® pulp is that form which is available originally from DuPont Company, and is shown generally in FIG. 7A. FIG. 7B shows an SEM image of the original Kevlar® pulp of FIG. 7A. As can be seen in the SEM images of FIGS. 7B, 8B, and 9B, original Kevlar® pulp shows a degree of entanglement between the 50% wet pulp of FIG. 8B and the pre-opened pulp of FIG. 9B.

Figure 8A:
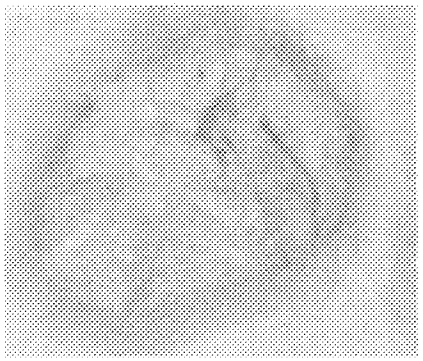
FIG. 8A is a photograph of 50% wet Kevlar® pulp.
Figure 8B:
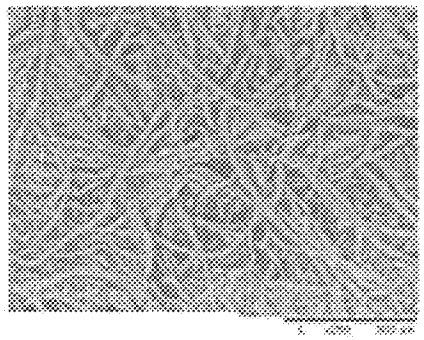
FIG. 8B is an SEM image of the 50% wet Kevlar® pulp of FIG. 8A.

50% wet Kevlar® pulp is the original pulp plus 50% by weight increased water content. 50% wet Kevlar® pulp is typically packed and condensed into pellet-like pieces. As shown in FIG. 8B, an SEM image shows the 50% wet pulp to have a high degree of entanglement, higher than the other forms of pulp tested. It is commonly used in the paper industry and is known to disperse easily into liquid mixes.

Figure 9A:
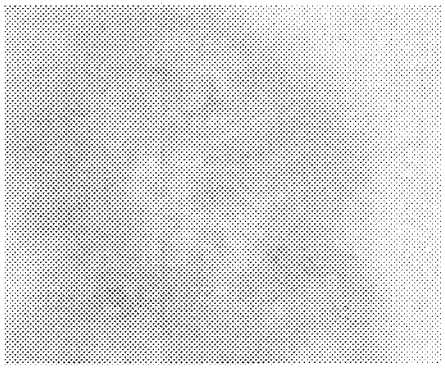
FIG. 9A is a photograph of pre-opened Kevlar® pulp.
Figure 9B:
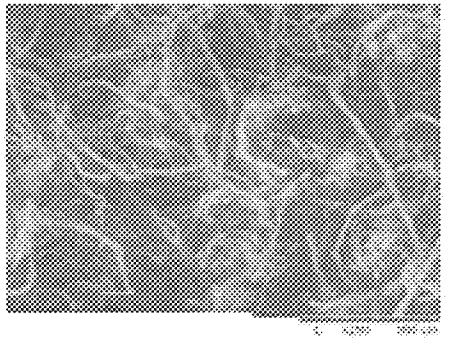
FIG. 9B is an SEM image of the pre-opened Kevlar® pulp of FIG. 9A.

Pre-opened Kevlar® pulp, as shown in FIG. 9A, is the original pulp that has been mechanically opened. The mechanical opening may be performed, for example, by a party other than the manufacturer of the original Kevlar® pulp, such as a distributor. The mechanical opening disentangles some of the pulp fibers, allowing for better dispersion in the mix. As shown in FIGS. 9A and 9B, pre-opened pulp has the lowest degree of entanglement of the Kevlar® forms tested.

TABLE 2 below shows a suitable polymeric formulation with 0.5 wt % fibrillated fibers (Kevlar® pulp).

TABLE 2

| .5 wt % Kevlar ® | |
|---|---|
| Component | Wt. % |
| TRM1190 Resin | 52.79% |
| Defoamer TRM1161 | 0.11% |
| Witcona TRM0240 | 0.11% |
| Wollastonite TRM0013 | 42.43% |
| Water | 4.06% |
| Pre-opened Kevlar ® Pulp | 0.50% |
| Total: | 100.00% |

TABLE 3 below shows a suitable polymeric formulation with 0.7 wt % fibrillated fibers (Kevlar® pulp).

TABLE 3

| .7% KP Make | |
|---|---|
| Component | Wt. % |
| TRM1190 Resin | 52.79% |
| Defoamer TRM1161 | 0.11% |
| Witcona TRM0240 | 0.11% |
| Wollastonite TRM0013 | 42.23% |
| Water | 4.06% |
| Pre-opened Kevlar ® Pulp | 0.70% |
| Total: | 100.00% |

As shown in TABLES 1-3 above, the addition of the Kevlar® pulp in whichever wt % amount is offset by a subtraction of filler (e.g. wollastonite) by the same wt % amount.

Fillers can be incorporated into the polymeric formulation to modify the rheology of formulation and the hardness and toughness of the cured binders. Examples of useful fillers include: metal carbonates such as calcium carbonate, sodium carbonate; silicas such as quartz, glass beads, glass bubbles; silicates such as talc, clays, calcium metasilicate; metal sulfate such as barium sulfate, calcium sulfate, aluminum sulfate; metal oxides such as calcium oxide, aluminum oxide; aluminum trihydrate, and wollastonite. In an embodiment, the amount of filler in the polymeric formulation can be at least about 10 wt %, at least about 15 wt %, at least about 20 wt %, or at least about 25 wt %. In another embodiment, the amount of filler in the polymeric formulation can be not greater than about 60 wt %, not greater than about 55 wt %, not greater than about 50 wt %, or not greater than about 45 wt %. The amount of filler in the polymeric formulation can be within a range comprising any pair of the previous upper and lower limits. In a particular embodiment, the amount of filler included in the polymeric formulation can be in the range of at least about 20 wt % to not greater than about 60 wt %. In some embodiments, the filler includes wollastonite and is included in an amount around 42 wt % to around 43 wt %, such as 42.93 wt %, 42.43 wt %, or 42.23 wt %.

The polymeric formulations can, optionally, further comprise one or more additives, including: coupling agents, such as silane coupling agents, for example A-174 and A-1100 available from Osi Specialties, Inc., organotitanates and zircoaluminates; anti-static agents, such as graphite, carbon black, and the like; suspending agents, such as fumed silica, for example Cab-0-Sil MS, Aerosil 200; anti-loading agents, such as zinc stearate; lubricants such as wax; wetting agents; dyes; fillers; viscosity modifiers; dispersants; and defoamers, such as TRM1161. The additives can be of the same or different types, alone or in combination with other types of additives. In an embodiment, the amount of total additives in the polymeric formulation can be at least about 0.1 wt %, at least about 1 wt %, or at least about 5 wt %. In another embodiment, the amount of total additives in the polymeric formulation can be not greater than about 25 wt %, not greater than about 20 wt %, not greater than about 15 wt %, or not greater than about 12 wt %. The amount of total additives in the polymeric formulation can be within a range comprising any pair of the previous upper and lower limits. In a particular embodiment, the amount of total additives included in the polymeric formulation can be in the range of at least about 0.1 wt % to not greater than about 20 wt %, such as at least about 0.1 wt % to not greater than about 15 wt %.

Polymeric formulation may also include solvents or may be solvent-free. Suitable solvents may be organic or aqueous. Suitable organic solvents are those which dissolve the resins of abrasive slurry, such as, for example, ketones, ethers, polar aprotic solvents, esters, aromatic solvents and aliphatic hydrocarbons, both linear and cyclic. Exemplary ketones include methyl ethyl ketone (2-butanone) (MEK), acetone and the like. Exemplary ethers include alkoxyalkyl ethers, such as methoxy methyl ether or ethyl ether, tetrahydrofuran, 1,4 dioxane and the like. Polar aprotic solvents include dimethyl formamide, dimethyl sulfoxide and the like. Suitable esters include alkyl acetates, such as ethyl acetate, methyl 65 acetate and the like. Aromatic solvents include alkylaryl solvents, such as toluene, xylene and the like and halogenated aromatics such as chlorobenzene and the like. Hydrocarbon type solvents include, for example, hexane, cyclohexane and the like.

Suitable aqueous solvents may be, for example, water, such as tap water, deionized water, or distilled water. In at least one embodiment of the present invention, the preferred solvent is water. The amount of solvent in the polymeric formulation can be at least about 1.0 wt %, at least about 2.0 wt %, at least about 3.0 wt %, or at least about 4.0 wt %. In another embodiment, the amount of solvent in the polymeric formulation can be not greater than about 8 wt %, not greater than about 7 wt %, not greater than about 6 wt %, not greater than about 5 wt %, or not greater than about 4 wt %. The amount of solvent in the polymeric formulation can be within a range comprising any pair of the previous upper and lower limits. In a particular embodiment, the amount of solvent included in the polymeric formulation can be in the range of at least about 3.0 wt % to not greater than about 5 wt %, and in a preferred embodiment is about 4.06 wt %. Additional solvent (e.g. additional water beyond the 4% water used in the initial formulation of at least the exemplary embodiments) is typically added to the formulation to adjust the viscosity to a target range, typically about 5000 cps, as discussed in the Examples further herein.

In a particular embodiment of the frontfill, the polymeric formulation has a composition that can include:

from about 37 wt % to about 67 wt % total polymer resin (monomers, oligomers, or combinations thereof), from about 0.1 wt % to about 3 wt % total fibrillated fibers, from about 10 wt % to about 60 wt % of total filler, from about 0.0 wt % to about 10 wt % total solvent, and from about 0.01 wt % to about 1.0 wt % of total additives (optional) where the percentages are based on total weight of the polymer formulation. The amounts of the abrasive slurry components are adjusted so that the total amounts add up to 100 wt %.

Curing can be accomplished by use of radiation or thermal sources. Where the cure is thermal, appropriate means can include ovens, hot lamps, heaters, and combinations thereof. Where the cure is activated by photo-initiators, a radiation source can be provided.

Once the resin is fully cured, the engineered coated backing is complete and can accept other layers and abrasive grains to be used for a variety of stock removal, finishing, and polishing applications. In one embodiment, the cured (dry) frontfill is between 2-10 mil in height, such as between 5-7 mil in height.

The fibrillated fibers in the polymeric formulation that formed the frontfill generally increase the viscosity of the wet polymer formulation and the stiffness of the cured polymer formulation. When processing the abrasive article to dispose thereupon one or more polymer formulation layers having the fibrillated fibers, extensions are formed on the surface of the layers, wherein at least a portion of the fibrillated fibers may extend or protrude through the layer surface such that at least a portion of the fibrillated fibers are exposed, and/or cause the layer itself to form protrusions or extensions comprising at least a portion of the fibrillated fibers wherein the fibrillated fibers are enclosed by the layer material. Processing that would likely provide at least a portion of the fibrillated fibers to extend through the layer surface and therefore be exposed may include, for example, not processing the surface of the layer with a blade, smoothing bar, or roller.

Figure 6:
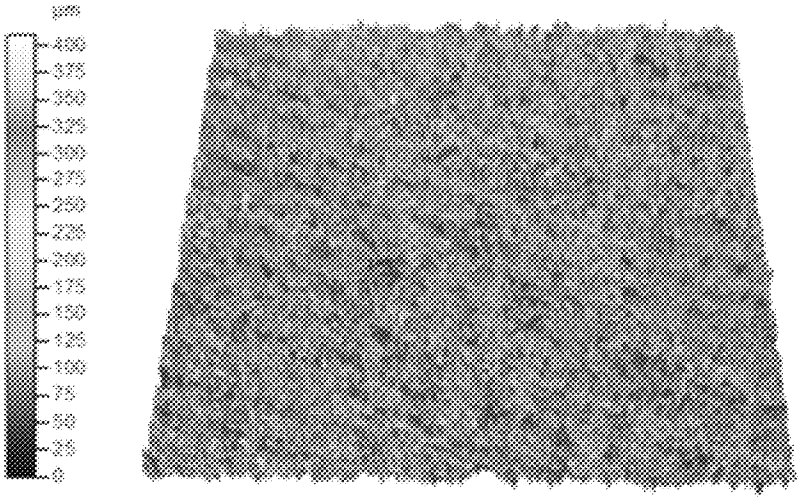
FIG. 6 is an image and graph related to an unmodified backing.
Figure 5:
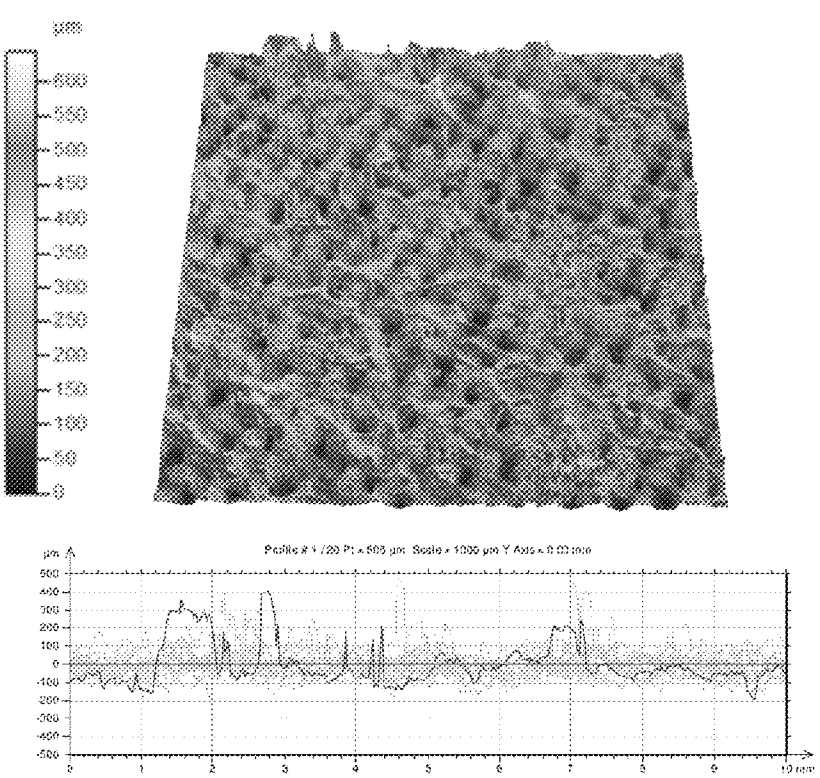
FIG. 5 is an image and graph related to an embodiment of a modified backing.

As shown in the FIG. 1, a portion of the fibrillated fibers 15 may extend through the frontfill 18 or may be entirely encapsulated by the frontfill material 18. In either case, the fibrillated fibers 15 form extensions or protrusions in the surface of the frontfill layer. The protrusions tend to form a high peaks 16 and deep holes 13 that extend above and below the average mean plane 19 of the frontfill layer. FIGS. 5 and 6 show images contrasting the extensions in a control sample frontfill having no fibrillated fibers (FIG. 5) and a frontfill sample having fibrillated fibers (FIG. 6). The samples that were the subject of the images of FIGS. 5 and 6 in particular included backing that was a cloth material and fibrillated fibers that included 0.7 wt % pre-opened Kevlar® pulp, which will be described further herein. It should be understood, however, that fibrillated fibers useful in embodiments of the present invention can include natural, synthetic, organic, inorganic, polymeric, aramid, poly-aramid, polypropylene, acrylic, and cellulose fibrillated fibers.

Figure 4:
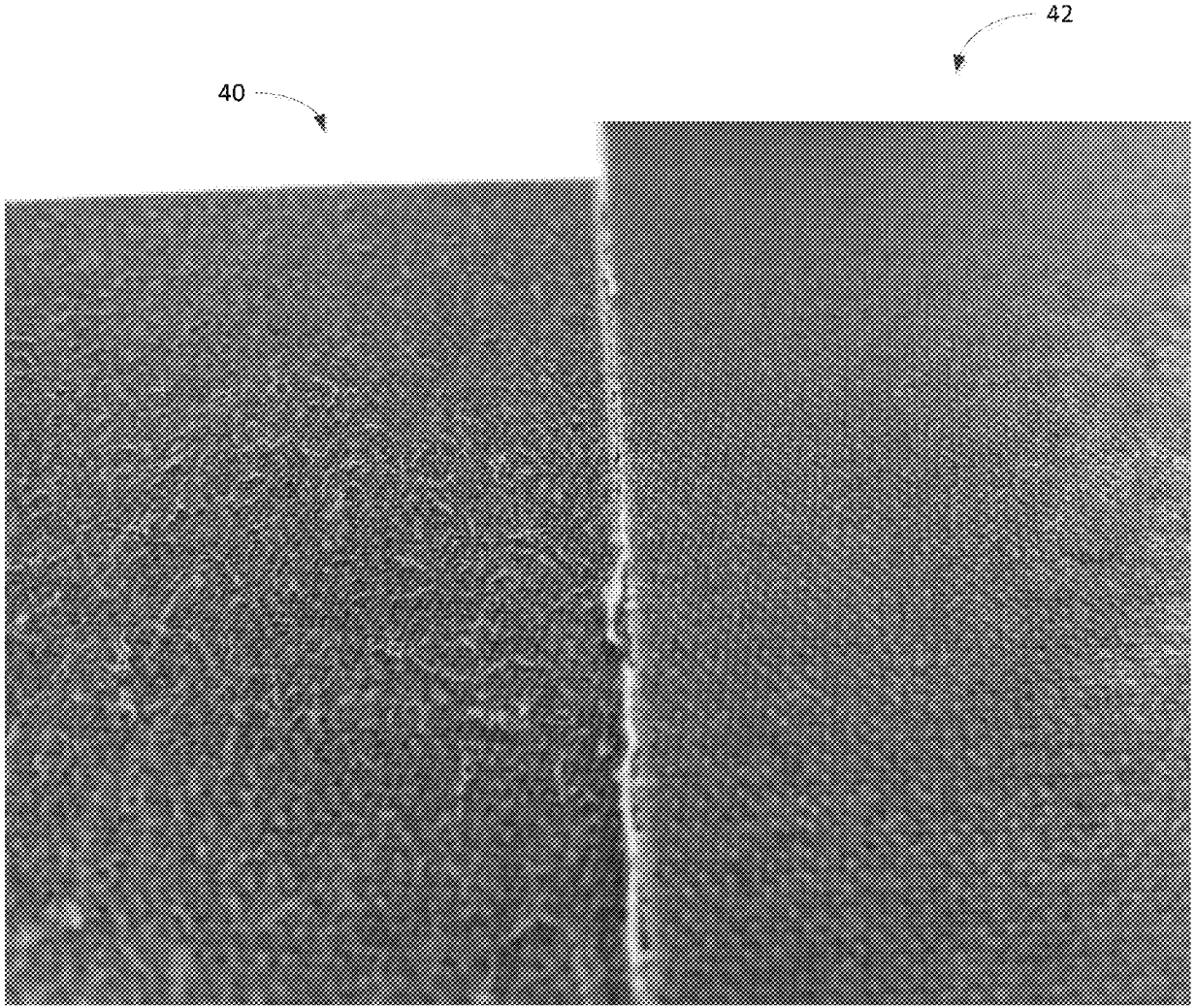
FIG. 4 is a photograph comparing an embodiment of a modified backing to an unmodified backing.

FIG. 4 shows an optical photograph comparison of backing with a frontfill layer 40 having fibrillated fibers, and backing with a frontfill layer 42 not having fibrillated fibers. As shown in FIG. 4, the layer 40 with the fibrillated fibers clearly shows portions of the fibrillated fibers extending through the surface of the frontfill such that they can be clearly seen by the naked eye, and has a "hairy" appearance. In FIGS. 5 and 6, the sample having fibrillated fibers (FIG. 5) generally shows higher peaks and/or deeper holes than the sample not having fibrillated fibers (FIG. 6). The baseline measurement (0 μm) is taken 500 μm below the highest peak for each sample. TABLE 4 below is a table showing the data of the images of FIGS. 5 and 6.

TABLE 4

| | Control Average (μm) | Fiber Average (μm) |
|---|---|---|
| Pp | 140 | 275 |
| Pv | 140 | 140 |
| Pz | 280 | 420 |
| Pt | 280 | 420 |
| Pa | 32 | 50 |
| Pq | 41 | 65 |

The values displayed above in TABLE 4 are averages from three spots on each sample. Within each spot, an average value is given for the spot size (10 mm×10 mm). A step size of 25 μm was used for both the X and Y axes for all samples. The samples were examined using a Micro Measure 3D Surface profilometer (i.e. white light chromatic aberration technique). The parameters were normalized to the ISO 4287 standard, and some parameters are listed in the EUR 15178 EN report.

Particularly, the average distance between the highest peak and mean plane (Pp) of the control sample without fibrillated fibers (FIG. 5) showed a distance of 140 μm, while the sample with the fibrillated fibers (FIG. 6) showed a distance of 275 μm, for a height difference of 135 μm. Thus, the extensions of the fibrillated sample extend above the average mean plane an average of 135 μm more than the average extensions of a frontfill without fibrillated fibers, and the distance between the highest peak and the average mean plane of the fibrillated fiber sample is typically between 140 μm and 415 μm.

TABLE 4 above also shows the height between the highest peak and deepest hole (Pt) to be 280 μm of the control sample (FIG. 5) and 420 μm of the fibrillated fiber sample (FIG. 6). Thus, the distance between the highest peak and the deepest hole of the sample having the fibrillated fibers is typically between 280 μm and 560 μm.

Although not wishing to be bound by theory, it is believed that the extensions or protrusions of fibrillated fibers increase inter-layer adhesion such as, for example, between a frontfill layer and a make coat or a make coat and a size coat. Also, as discussed further herein, it is believed that the portion of fibrillated fibers within the layer increases layer stiffness and abrasive grain retention, while providing crack deflection and a more desirable abrasive grain orientation. One or more of the following advantages may be obtained by the addition of a particular amount, as discussed further herein, of fibrillated fibers to one or more of the layers of an abrasive article, including, for example, increased coating strength, increased tear strength, increased grinding performance, and increased grinding effect.

Figure 2:
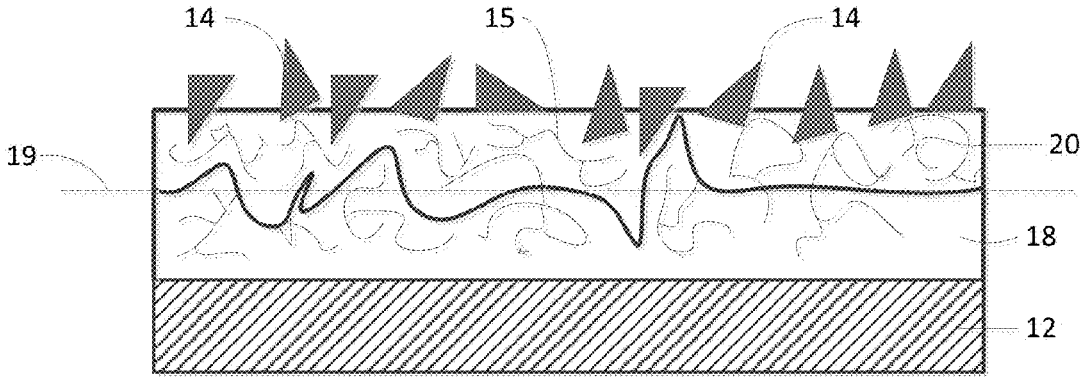
FIG. 2 is an illustration of a cross-section of an embodiment of a coated abrasive article.

Referring back to FIGS. 1-3, as discussed above, the fibrillated fibers may be included in one or more polymer formulation layers of an abrasive article. The term "make" or "make coat" refers to the layer of adhesive that goes between a backing material and abrasive grains. To this end, abrasive grains 14 are dispersed generally upon and/or within the make coat 20. Although the embodiment of FIG. 2 shows fibrillated fibers 15 dispersed within the make coat 20 and the frontfill 18, it should be understood that the present invention allows for fibrillated fibers to be dispersed generally within one or more layers of an abrasive article, and further allows for portions of the fibrillated fibers to extend or protrude through one or more layers in kind.

The polymer formulation to be used in the make coat 20 may be the same or different from those described above with respect to the frontfill 12. For example, when used to form the make coat, the polymer formulation generally includes a urea formaldehyde resin, filler material, and optional other additives. In some preferred embodiments, the polymer resin for the make coat includes urea formaldehyde resin in the range of between 62 wt % to 92 wt %, such as in the range of between 67 wt. % to 87 wt %, such as in the range of between 72 wt % to 82 wt %, such as about 77 wt. %. TABLE 5 below shows a urea formaldehyde resin formulation as a suitable make coat formulation for use with the present invention.

TABLE 5

| Control/General - Make | |
|---|---|
| 510041616 RES UREA FORMALD 2058 can be replaced with C331-144 (TRM 0833) | 77% |
| 510041596 FILL SNOW WHITE | 19.00% |
| 150015870 MIX NH4CL CAT 25% SOLN | 2.70% |
| 510041601 ADD AMP 95 | 0.53% |
| 510041612 ADD AMINO SILANE Z6026 Can be replaced with Siquest A1100 Silane | 0.38% |
| 510041614 ADD SPAN 20 | 0.38% |
| Dynol 604 | 0.31% |

As shown above in TABLE 5, the general formulation of a urea formaldehyde resin suitable for a make coat of some embodiments of the present invention typically includes urea formaldehyde (about 77 wt %), wollastonite (snow white) filler (about 19 wt %), ammonium chloride catalyst 25% solution (about 2.7 wt %), and additives such as amino silane (0.38 wt %), span 20 (0.38 wt %), and Dynol (0.31 wt %).

Optionally, the make coat may also include fibrillated fibers (preferably in the form of pulp). TABLE 6 below shows a urea formaldehyde resin formulation with additional Kevlar® pulp fibrillated fibers at 0.7 wt % as a suitable make coat formulations for use with the present invention.

TABLE 6

| .7% KP - Make | |
|---|---|
| 510041616 RES UREA FORMALD 2058 can be replaced with C331-144 (TRM 0833) | 77% |
| 510041596 FILL SNOW WHITE | 18.30% |
| 150015870 MIX NH4CL CAT 25% SOLN | 2.70% |
| 510041601 ADD AMP 95 | 0.53% |
| 510041612 ADD AMINO SILANE Z6026 Can be replaced with Siquest A1100 Silane | 0.38% |
| 510041614 ADD SPAN 20 | 0.38% |
| Dynol 604 | 0.31% |
| Preopened Kevlar ® Pulp | 0.70% |

The fillers incorporated into the polymeric formulation for the make coat may be similar or different from that used and discussed above with respect to the frontfill. In some embodiments, the filler includes wollastonite (i.e. snow white) and is included in an amount around 9 wt % to around 29 wt %, such as an amount around 14 wt % to around 24 wt %, such as an amount around 17 wt % to around 21 wt %, such as an amount around 18 wt % to around 19 wt %, such as 18.30 wt % or 19 wt %.

The polymeric formulations can, optionally, further comprise one or more additives, such as those described above with respect to the frontfill, and/or can include ammonium chloride (Nh4Cl) 25% solution, AMP 95 (co-dispersant and neutralizing amine), amino silane (lubricant and emulsifier), and/or Dynol 604 (surfactant). In at least one embodiment, the amount of total additives in the polymeric formulation can be at least about 0.1 wt %, at least about 5 wt %. In another embodiment, the amount of total additives in the polymeric formulation can be not greater than about 10 wt %, not greater than about 5 wt %, or not greater than about 4 wt %. The amount of total additives in the polymeric formulation can be within a range comprising any pair of the previous upper and lower limits. In a particular embodiment, the amount of total additives included in the polymeric formulation can be in the range of at least about 0.1 wt % to not greater than about 5 wt %, such as at least about 0.1 wt % to not greater than about 4.3 wt %. In one preferred embodiment, the amount of total additives is not less than 3.5 wt %, such as not less than 4.3 wt %, such as not less than 4.5 wt %, such as not less than 4.7 wt %.

Polymeric formulations for the make coat may optionally include solvents, such as those described above with respect to the frontfill. However, in some preferred embodiments, the polymeric formulation for the make coat is "neat," that is, does not contain solvents.

In a particular embodiment of the make coat, the polymeric formulation has a composition that can include:

from about 67 wt % to about 92 wt % total polymer resin (monomers, oligomers, or combinations thereof), from about 0.1 wt % to about 3 wt % total fibrillated fibers, from about 9 wt % to about 29 wt % of total filler, and from about 0.00 wt % to about 7.0 wt % of total additives, where the percentages are based on total weight of the polymer formulation. The amounts of the abrasive slurry components are adjusted so that the total amounts add up to 100 wt %.

In addition, abrasive grains are included in or on the polymer formulation of the make coat. The abrasive grains that are considered suitable for use in the present invention are generally any abrasive grains known in the art. Examples of suitable abrasive compositions may include non-metallic, inorganic solids such as carbides, oxides, nitrides and certain carbonaceous materials. Oxides include silicon oxide (such as quartz, cristobalite and glassy forms), cerium oxide, zirconium oxide, aluminum oxide. Carbides and nitrides include, but are not limited to, silicon carbide, aluminum, boron nitride (including cubic boron nitride), titanium carbide, titanium nitride, silicon nitride. Carbonaceous materials include diamond, which broadly includes synthetic diamond, diamond-like carbon, and related carbonaceous materials such as fullerite and aggregate diamond nanorods. Materials may also include a wide range of naturally occurring mined minerals, such as garnet, cristobalite, quartz, corundum, feldspar, by way of example. Certain embodiments of the present disclosure may take advantage of diamond, silicon carbide, aluminum oxide, and/or cerium oxide materials. In addition, those of skill will appreciate that various other compositions possessing the desired hardness characteristics may be used as abrasive grains suitable with the present invention. In addition, in certain embodiments according to the present disclosure, mixtures of two or more different abrasive grains can be used in the same abrasive product. Moreover, in certain embodiments according to the present disclosure, the abrasive particles or grains may have specific contours that define particularly shaped abrasive particles.

Figure 20:
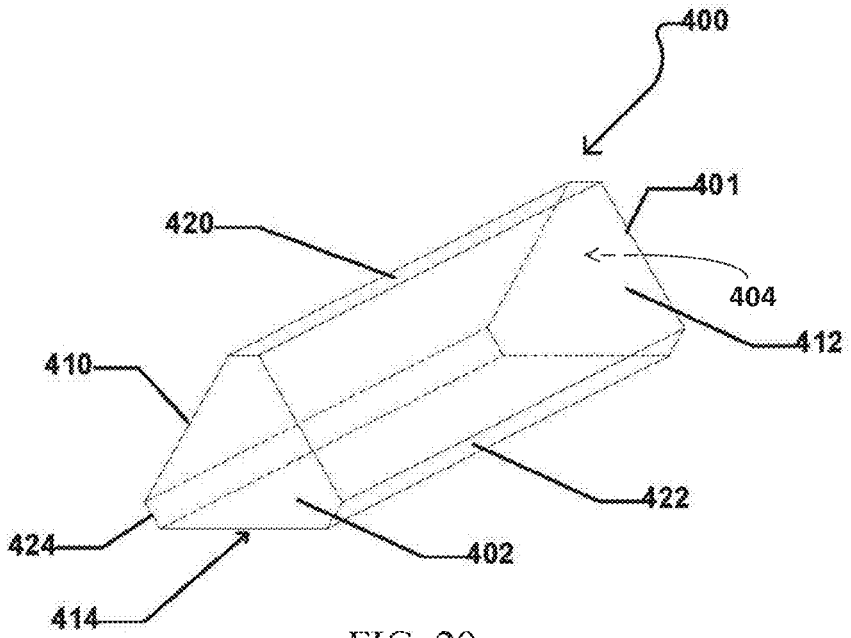
FIG. 20 is an illustration of a shaped abrasive article suitable for use with embodiments of the present invention.

FIGS. 20-25 include exemplary abrasive particulate material having specific contours and defining shaped abrasive particles, which can incorporate the compositions described herein. As shown in FIG. 20, the shaped abrasive particle 400 may include a body 401 that is generally prismatic with a first end face 402 and a second end face 404. Further, the shaped abrasive particle 400 may include a first side face 410 extending between the first end face 402 and the second end face 404. A second side face 412 may extend between the first end face 402 and the second end face 404 adjacent to the first side face 410. As shown, the shaped abrasive particle 400 may also include a third side face 414 extending between the first end face 402 and the second end face 404 adjacent to the second side face 412 and the first side face 410.

As depicted in FIG. 20, the shaped abrasive particle 400 may also include a first edge 420 between the first side face 410 and the second side face 412. The shaped abrasive particle 400 may also include a second edge 422 between the second side face 412 and the third side face 414. Further, the shaped abrasive particle 400 may include a third edge 424 between the third side face 414 and the first side face 412.

As shown, each end face 402, 404 of the shaped abrasive particle 400 may be generally triangular in shape. Each side face 410, 412, 414 may be generally rectangular in shape. Further, the cross section of the shaped abrasive particle 400 in a plane parallel to the end faces 402, 404 can be generally triangular. It will be appreciated that while the cross-sectional shape of the shaped abrasive particle 400 through a plane parallel to the end faces 402, 404 is illustrated as being generally triangular, other shapes are possible, including any polygonal shapes, for example a quadrilateral, a pentagon, a hexagon, a heptagon, an octagon, a nonagon, a decagon, etc. Further, the cross-sectional shape of the shaped abrasive particle may be convex, non-convex, concave, or non-concave.

Figure 21:
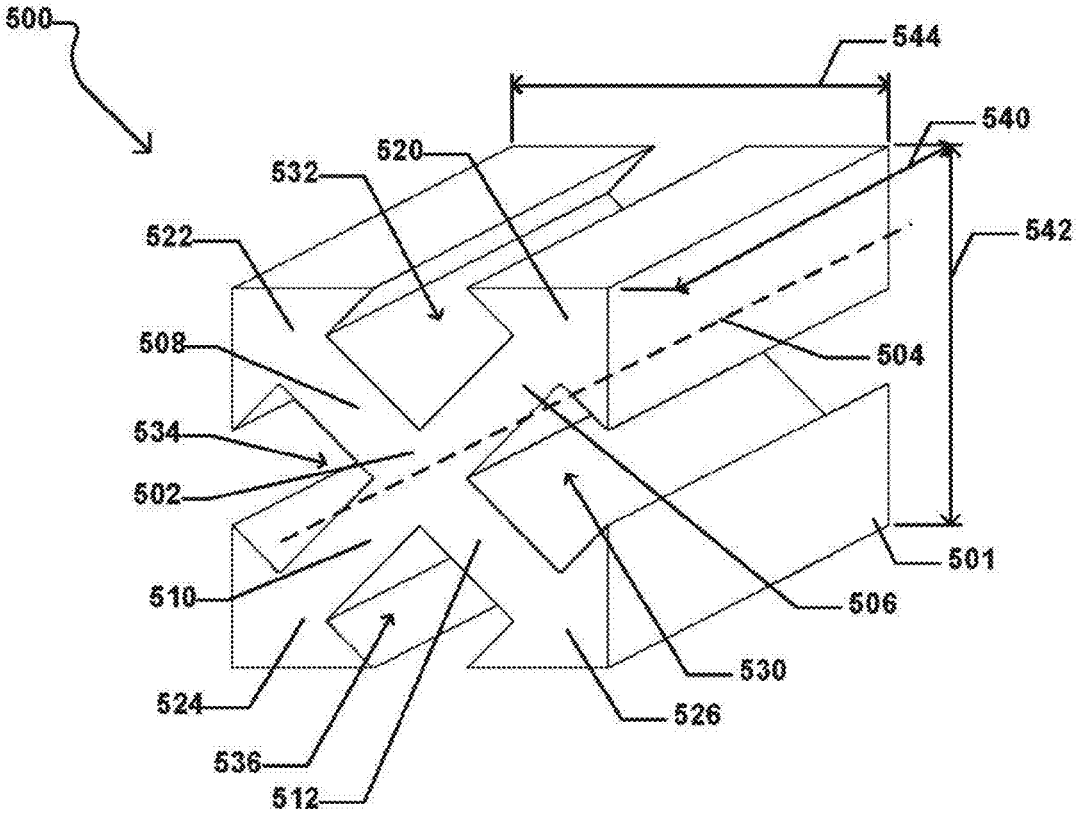
FIG. 21 is an illustration of a shaped abrasive article suitable for use with embodiments of the present invention.

FIG. 21 includes an illustration of a shaped abrasive particle according to another embodiment. As depicted, the shaped abrasive particle 500 may include a body 501 that may include a central portion 502 that extends along a longitudinal axis 504. A first radial arm 506 may extend outwardly from the central portion 502 along the length of the central portion 502. A second radial arm 508 may extend outwardly from the central portion 502 along the length of the central portion 502. A third radial arm 510 may extend outwardly from the central portion 502 along the length of the central portion 502. Moreover, a fourth radial arm 512 may extend outwardly from the central portion 502 along the length of the central portion 502. The radial arms 506, 508, 510, 512 may be equally spaced around the central portion 502 of the shaped abrasive particle 500.

As shown in FIG. 21, the first radial arm 506 may include a generally arrow shaped distal end 520. The second radial arm 508 may include a generally arrow shaped distal end 522. The third radial arm 510 may include a generally arrow shaped distal end 524. Further, the fourth radial arm 512 may include a generally arrow shaped distal end 526.

FIG. 21 also indicates that the shaped abrasive particle 500 may be formed with a first void 530 between the first radial arm 506 and the fourth radial arm 512. A second void 532 may be formed between the second radial arm 508 and the first radial arm 506. A third void 534 may also be formed between the third radial arm 510 and the second radial arm 508. Additionally, a fourth void 536 may be formed between the fourth radial arm 512 and the third radial arm 510.

As shown in FIG. 21, the shaped abrasive particle 500 may include a length 540, a height 542, and a width 544. In a particular aspect, the length 540 is greater than the height 542 and the height 542 is greater than the width 544. In a particular aspect, the shaped abrasive particle 500 may define a primary aspect ratio that is the ratio of the length 540 to the height 542 (length:height). Further, the shaped abrasive particle 500 may define a secondary aspect ratio that is the ratio of the height 542 to the width 544 (width:width). Finally, the shaped abrasive particle 500 may define a tertiary aspect ratio that is the ratio of the length 540 to the width 544 (length:width).

According to one embodiment, the shaped abrasive particles can have a primary aspect ratio of at least about 1:1, such as at least about 1.1:1, at least about 1.5:1, at least about 2:1, at least about 2.5:1, at least about 3:1, at least about 3.5:1, at least 4:1, at least about 4.5:1, at least about 5:1, at least about 6:1, at least about 7:1, at least about 8:1, or even at least about 10:1.

In another instance, the shaped abrasive particle can be formed such that the body has a secondary aspect ratio of at least about 0.5:1, such as at least about 0.8:1, at least about 1:1, at least about 1.5:1, at least about 2:1, at least about 2.5:1, at least about 3:1, at least about 3.5:1, at least 4:1, at least about 4.5:1, at least about 5:1, at least about 6:1, at least about 7:1, at least about 8:1, or even at least about 10:1.

Furthermore, certain shaped abrasive particles can have a tertiary aspect ratio of at least about 1:1, such as at least about 1.5:1, at least about 2:1, at least about 2.5:1, at least about 3:1, at least about 3.5:1, at least 4:1, at least about 4.5:1, at least about 5:1, at least about 6:1, at least about 7:1, at least about 8:1, or even at least about 10:1.

Certain embodiments of the shaped abrasive particle 500 can have a shape with respect to the primary aspect ratio that is generally rectangular, e.g., flat or curved. The shape of the shaped abrasive particle 500 with respect to the secondary aspect ratio may be any polyhedral shape, e.g., a triangle, a square, a rectangle, a pentagon, etc. The shape of the shaped abrasive particle 500 with respect to the secondary aspect ratio may also be the shape of any alphanumeric character, e.g., 1, 2, 3, etc., A, B, C. etc. Further, the contour of the shaped abrasive particle 500 with respect to the secondary aspect ratio may be a character selected from the Greek alphabet, the modern Latin alphabet, the ancient Latin alphabet, the Russian alphabet, any other alphabet, or any combination thereof. Further, the shape of the shaped abrasive particle 500 with respect to the secondary aspect ratio may be a Kanji character.

Figure 22:
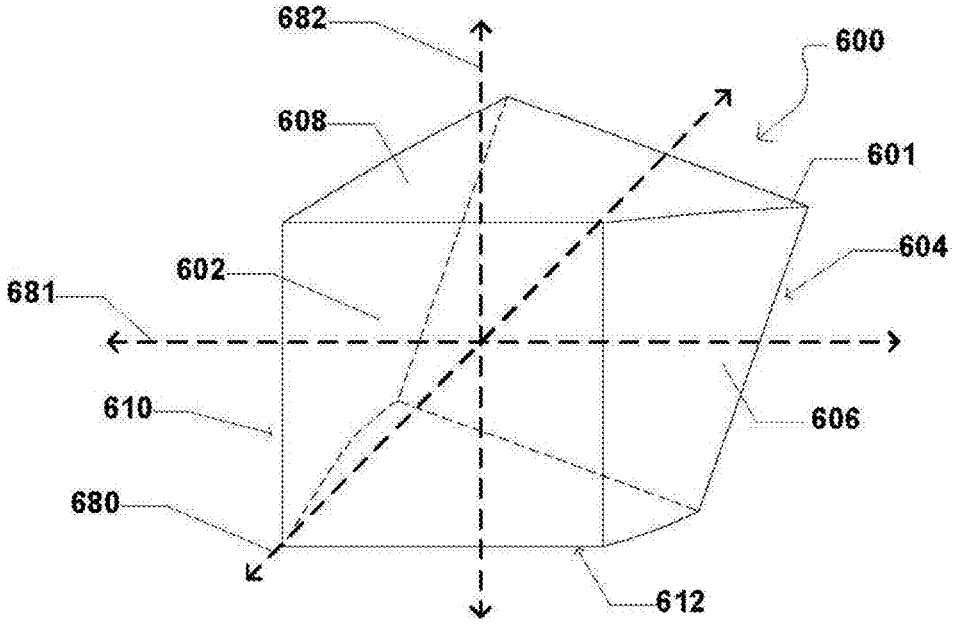
FIG. 22 is an illustration of a shaped abrasive article suitable for use with embodiments of the present invention.
Figure 23:
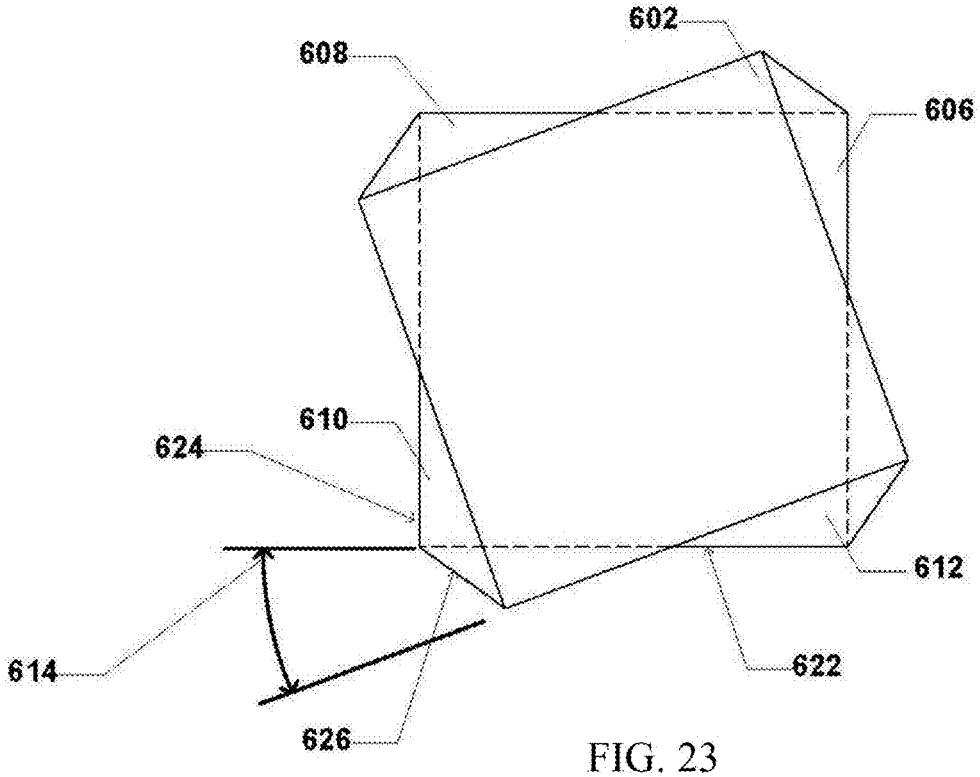
FIG. 23 is an illustration of a shaped abrasive article suitable for use with embodiments of the present invention.

FIGS. 22-23 depict another embodiment of a shaped abrasive particle that is generally designated 600. As shown, the shaped abrasive particle 600 may include a body 601 that has a generally cube-like shape. It will be appreciated that the shaped abrasive particle may be formed to have other polyhedral shapes. The body 601 may have a first end face 602 and a second end face 604, a first lateral face 606 extending between the first end face 602 and the second end face 604, a second lateral face 608 extending between the first end face 602 and the second end face 604. Further, the body 601 can have a third lateral face 610 extending between the first end face 602 and the second end face 604, and a fourth lateral face 612 extending between the first end face 602 and the second end face 604.

As shown, the first end face 602 and the second end face 604 can be parallel to each other and separated by the lateral faces 606, 608, 610, and 612, giving the body a cube-like structure. However, in a particular aspect, the first end face 602 can be rotated with respect to the second end face 604 to establish a twist angle 614. The twist of the body 601 can be along one or more axes and define particular types of twist angles. For example, as illustrated in a top-down view of the body in FIG. 23 looking down the longitudinal axis 680 defining a length of the body 601 on the end face 602 parallel to a plane defined by the lateral axis 681 extending along a dimension of width of the body 601 and the vertical axis 682 extending along a dimension of height of the body 601. According to one embodiment, the body 601 can have a longitudinal twist angle 614 defining a twist in the body 601 about the longitudinal axis such that the end faces 602 and 604 are rotated relative to each other. The twist angle 614, as illustrated in FIG. 23 can be measured as the angle between a tangent of a first edge 622 and a second edge 624, wherein the first edge 622 and second edge 624 are joined by and share a common edge 626 extending longitudinally between two of the lateral faces (610 and 612). It will be appreciated that other shaped abrasive particles can be formed to have twist angles relative to the lateral axis, the vertical axis, and a combination thereof. Any of such twist angles can have a value as described herein.

In a particular aspect, the twist angle 614 is at least about 1°. In other instances, the twist angle can be greater, such as at least about 2°, at least about 5°, at least about 8°, at least about 10°, at least about 12°, at least about 15°, at least about 18°, at least about 20°, at least about 25°, at least about 30°, at least about 40°, at least about 50°, at least about 60°, at least about 70°, at least about 80°, or even at least about 90°. Still, according to certain embodiments, the twist angle 614 can be not greater than about 360°, such as not greater than about 330°, such as not greater than about 300°, not greater than about 270°, not greater than about 230°, not greater than about 200°, or even not greater than about 180°. It will be appreciated that certain shaped abrasive particles can have a twist angle within a range between any of the minimum and maximum angles noted above.

Further, the body may include an opening that extends through the entire interior of the body along one of the longitudinal axis, lateral axis, or vertical axis.

Figure 24:
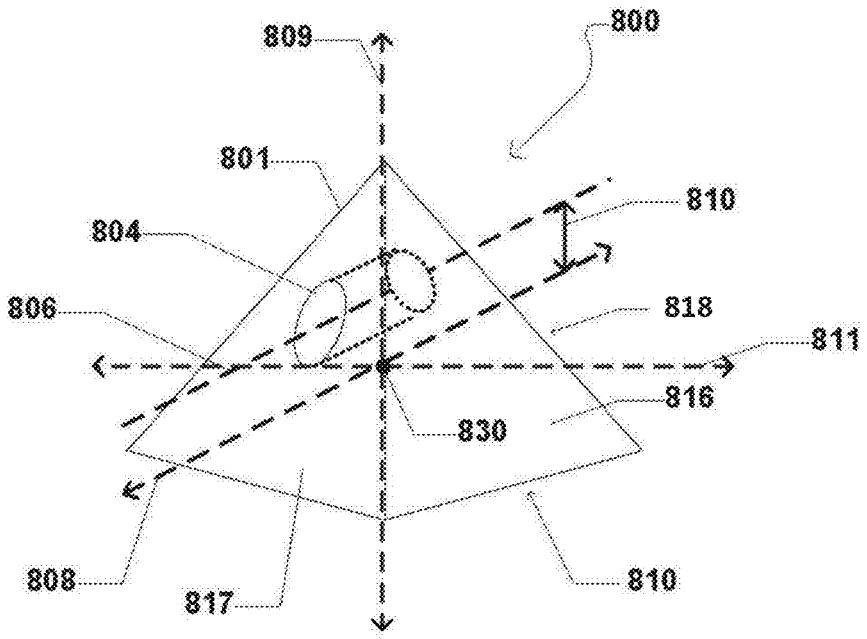
FIG. 24 is an illustration of a shaped abrasive article suitable for use with embodiments of the present invention.

FIG. 24 includes an illustration of another embodiment of a shaped abrasive particle. As shown, the shaped abrasive particle 800 may include a body 801 having a generally pyramid shaped with a generally triangle or square shaped bottom face. The body can further include sides 816, 817, and 818 connected to each other and the bottom face 802. It will be appreciated that while the body 801 is illustrated as having a pyramidal polyhedral shape, other shapes are possible, as described herein.

According to one embodiment, the shaped abrasive particle 800 may be formed with a hole 804 (i.e., and opening) that can extend through at least a portion of the body 801, and more particularly may extend through an entire volume of the body 801. In a particular aspect, the hole 804 may define a central axis 806 that passes through a center of the hole 804. Further, the shaped abrasive particle 800 may also define a central axis 808 that passes through a center 830 of the shaped abrasive particle 800. It may be appreciated that the hole 804 may be formed in the shaped abrasive particle 800 such that the central axis 806 of the hole 804 is spaced apart from the central axis 808 by a distance 810. As such, a center of mass of the shaped abrasive particle 800 may be moved below the geometric midpoint 830 of the shaped abrasive particle 800, wherein the geometric midpoint 830 can be defined by the intersection of a longitudinal axis 809, vertical axis 811, and the central axis (i.e., lateral axis) 808. Moving the center of mass below the geometric midpoint 830 of the shaped abrasive grain can increase the likelihood that the shaped abrasive particle 800 lands on the same face, e.g., the bottom face 802, when dropped, or otherwise deposited, onto a backing, such that the shaped abrasive particle 800 has a predetermined, upright orientation.

In a particular embodiment, the center of mass is displaced from the geometric midpoint 830 by a distance that can be at least about 0.05 the height (h) along a vertical axis 810 of the body 802 defining a height. In another embodiment, the center of mass may be displaced from the geometric midpoint 830 by a distance of at least about 0.1(h), such as at least about 0.15(h), at least about 0.18(h), at least about 0.2(h), at least about 0.22(h), at least about 0.25(h), at least about 0.27(h), at least about 0.3(h), at least about 0.32(h), at least about 0.35 (h), or even at least about 0.38(h). Still, the center of mass of the body 801 may be displaced a distance from the geometric midpoint 830 of no greater than 0.5(h), such as no greater than 0.49 (h), no greater than 0.48(h), no greater than 0.45(h), no greater than 0.43(h), no greater than 0.40(h), no greater than 0.39(h), or even no greater than 0.38(h). It will be appreciated that the displacement between the center of mass and the geometric midpoint can be within a range between any of the minimum and maximum values noted above.

In particular instances, the center of mass may be displaced from the geometric midpoint 830 such that the center of mass is closer to a base, e.g., the bottom face 802, of the body 801, than a top of the body 801 when the shaped abrasive particle 800 is in an upright orientation as shown in FIG. 24.

In another embodiment, the center of mass may be displaced from the geometric midpoint 830 by a distance that is at least about 0.05 the width (w) along a lateral axis 808 of the of the body 801 defining the width. In another aspect, the center of mass may be displaced from the geometric midpoint 830 by a distance of at least about 0.1(w), such as at least about 0.15(w), at least about 0.18(w), at least about 0.2(w), at least about 0.22(w), at least about 0.25(w), at least about 0.27(w), at least about 0.3(w), or even at least about 0.35(w). Still, in one embodiment, the center of mass may be displaced a distance from the geometric midpoint 830 no greater than 0.5(w), such as no greater than 0.49 (w), no greater than 0.45(w), no greater than 0.43(w), no greater than 0.40(w), or even no greater than 0.38(w).

In another embodiment, the center of mass may be displaced from the geometric midpoint 830 along the longitudinal axis 809 by a distance (Dl) of at least about 0.05 the length (l) of the body 801. According to a particular embodiment, the center of mass may be displaced from the geometric midpoint by a distance of at least about 0.1(l), such as at least about 0.15(l), at least about 0.18(l), at least about 0.2(l), at least about 0.25(l), at least about 0.3(l), at least about 0.35(l), or even at least about 0.38(1). Still, for certain abrasive particles, the center of mass can be displaced a distance no greater than about 0.5(l), such as no greater than about 0.45(l), or even no greater than about 0.40(l).

Figure 25:
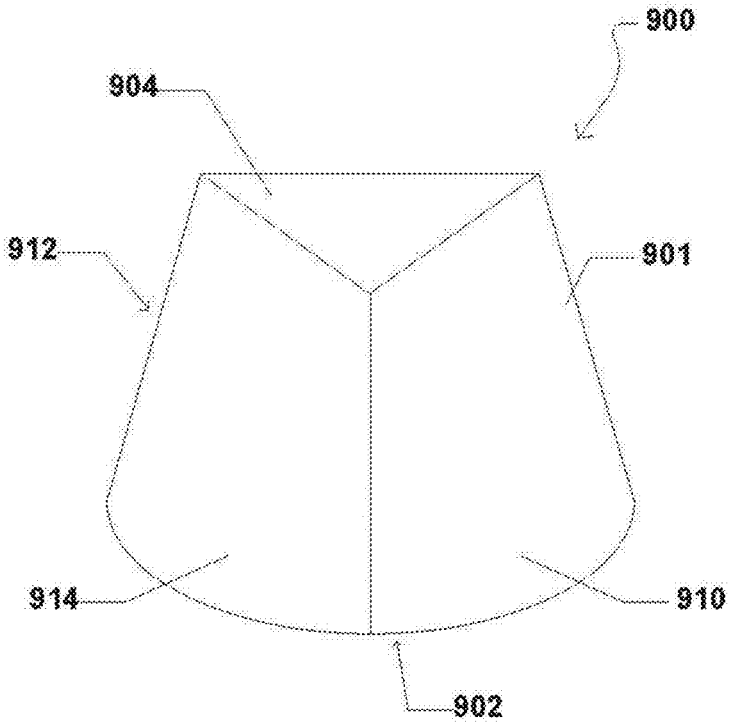
FIG. 25 is an illustration of a shaped abrasive article suitable for use with embodiments of the present invention.

FIG. 25 includes an illustration of a shaped abrasive particle according to an embodiment. The shaped abrasive grain 900 may include a body 901 including a base surface 902 and an upper surface 904 separated from each other by one or more side surfaces 910, 912, and 914. According to one particular embodiment, the body 901 can be formed such that the base surface 902 has a planar shape different than a planar shape of the upper surface 904, wherein the planar shape is viewed in the plane defined by the respective surface. For example, as illustrated in the embodiment of FIG. 25, the body 901 can have base surface 902 generally have a circular shape and an upper surface 904 having a generally triangular shape. It will be appreciated that other variations are feasible, including any combination of shapes at the base surface 902 and upper surface 904.

Additionally, the body of the shaped abrasive particles can have particular two-dimensional shapes. For example, the body can have a two-dimensional shape as viewed in a plane define by the length and width having a polygonal shape, ellipsoidal shape, a numeral, a Greek alphabet character, Latin alphabet character, Russian alphabet character, complex shapes utilizing a combination of polygonal shapes and a combination thereof. Particular polygonal shapes include triangular, rectangular, quadrilateral, pentagon, hexagon, heptagon, octagon, nonagon, decagon, any combination thereof.

Figure 26A:
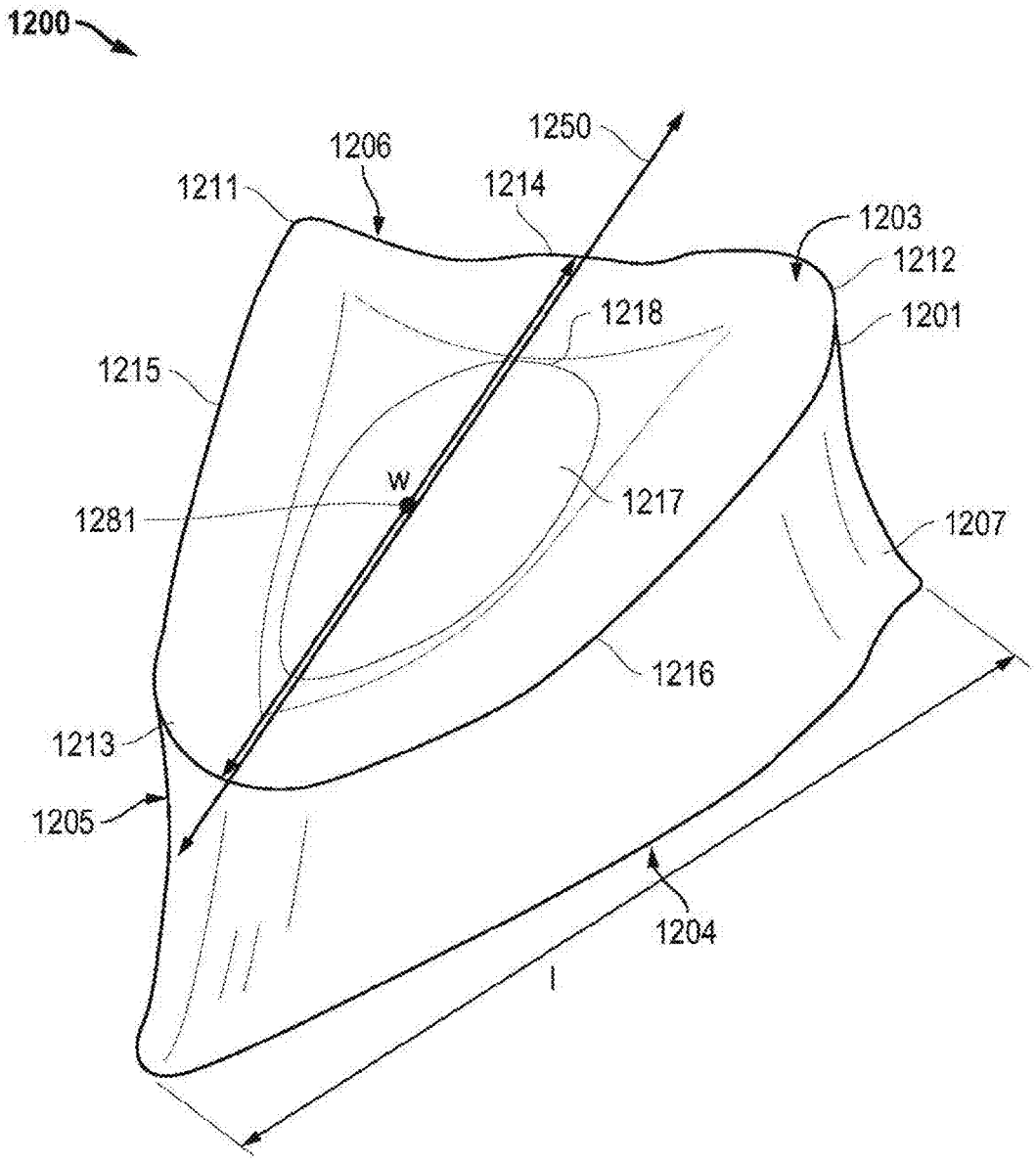
FIG. 26A is an illustration of a shaped abrasive article suitable for use with embodiments of the present invention.

FIG. 26A includes a perspective view illustration of an abrasive particle in accordance with an embodiment. Additionally, FIG. 26B includes a cross-sectional illustration of the abrasive particle of FIG. 26A. The body 1201 includes an upper surface 1203 a bottom major surface 1204 opposite the upper surface 1203. The upper surface 1203 and the bottom surface 1204 can be separated from each other by side surfaces 1205, 1206, and 1207. As illustrated, the body 1201 of the shaped abrasive particle 1200 can have a generally triangular shape as viewed in a plane of the upper surface 1203 defined by the length (l) and width (w) of the body 1201. In particular, the body 1201 can have a length (l), a width (w) extending through a midpoint 1281 of the body 1201.

In accordance with an embodiment, the body 1201 of the shaped abrasive particle can have a first height (h1) at a first end of the body defined by a corner 1213. Notably, the corner 1213 may represent the point of greatest height on the body 1201. The corner can be defined as a point or region on the body 1201 defined by the joining of the upper surface 1203, and two side surfaces 1205 and 1207. The body 1201 may further include other corners, spaced apart from each other, including for example corner 1211 and corner 1212. As further illustrated, the body 1201 can include edges 1214, 1215, and 1216 that can separated from each other by the corners 1211, 1212, and 1213. The edge 1214 can be defined by an intersection of the upper surface 1203 with the side surface 1206. The edge 1215 can be defined by an intersection of the upper surface 1203 and side surface 1205 between corners 1211 and 1213. The edge 1216 can be defined by an intersection of the upper surface 1203 and side surface 1207 between corners 1212 and 1213.

Figure 26B:
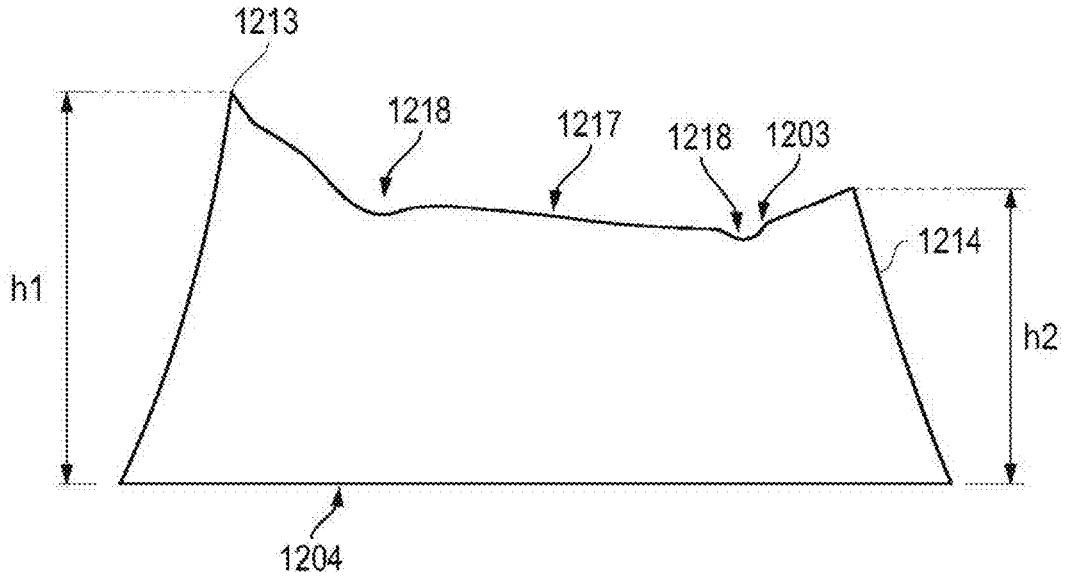
FIG. 26B is a side profile view of the shaped abrasive article of FIG. 26A.

As further illustrated, the body 1201 can include a second height (h2) at a second end of the body, which defined by the edge 1214, and further which is opposite the first end defined by the corner 1213. The axis 1250 can extend between the two ends of the body 1201. FIG. 26B is a cross-sectional illustration of the body 1201 along the axis 1250, which can extend through a midpoint 1281 of the body along the dimension of width (w) between the ends of the body 1201.

In accordance with an embodiment, the shaped abrasive particles of the embodiments herein, including for example, the particle of FIGS. 26A and 26B can have an average difference in height, which is a measure of the difference between h1 and h2. More particularly, the average difference in height can be calculated based upon a plurality of shaped abrasive particles from a sample. The sample can include a representative number of shaped abrasive particles, which may be randomly selected from a batch, such as at least 8 particles, or even at least 10 particles. A batch can be a group of shaped abrasive particles that are produced in a single forming process, and more particularly, in the same, single forming process. The average difference can be measured via using a STIL (Sciences et Techniques Industrielles de la Lumiere—France) Micro Measure 3D Surface Profilometer (white light (LED) chromatic aberration technique).

In particular instances, the average difference in height [h1−h2], wherein h1 is greater, can be at least about 50 microns. In still other instances, the average difference in height can be at least about 60 microns, such as at least about 65 microns, at least about 70 microns, at least about 75 microns, at least about 80 microns, at least about 90 microns, or even at least about 100 microns. In one non-limiting embodiment, the average difference in height can be not greater than about 300 microns, such as not greater than about 250 microns, not greater than about 220 microns, or even not greater than about 180 microns. It will be appreciated that the average difference in height can be within a range between any of the minimum and maximum values noted above.

Moreover, the shaped abrasive particles herein, including for example the particle of FIGS. 26A and 26B, can have a profile ratio of average difference in height [h1−h2] to profile length (lp) of the shaped abrasive particle, defined as [(h1−h2)/(lp)] of at least about 0.04. It will be appreciated that the profile length of the body can be a length of the scan across the body used to generate the data of h1 and h2 between opposite ends of the body. Moreover, the profile length may be an average profile length calculated from a sample of multiple particles that are measured. In certain instances, the profile length (lp) can be the same as the width as described in embodiments herein. According to a particular embodiment, the profile ratio can be at least about 0.05, at least about 0.06, at least about 0.07, at least about 0.08, or even at least about 0.09. Still, in one non-limiting embodiment, the profile ratio can be not greater than about 0.3, such as not greater than about 0.2, not greater than about 0.18, not greater than about 0.16, or even not greater than about 0.14. It will be appreciated that the profile ratio can be within a range between any of the minimum and maximum values noted above.

Moreover, the shaped abrasive particles of the embodiments herein, including for example, the body 1201 of the particle of FIGS. 26A and 26B can have a bottom surface 1204 defining a bottom area (Ab). In particular instances the bottom surface 1204 can be the largest surface of the body 1201. The bottom surface can have a surface area defined as the bottom area (Ab) that is greater than the surface area of the upper surface 1203. Additionally, the body 1201 can have a cross-sectional midpoint area (Am) defining an area of a plane perpendicular to the bottom area and extending through a midpoint 1281 of the particle. In certain instances, the body 1201 can have an area ratio of bottom area to midpoint area (Ab/Am) of not greater than about 6. In more particular instances, the area ratio can be not greater than about 5.5, such as not greater than about 5, not greater than about 4.5, not greater than about 4, not greater than about 3.5, or even not greater than about 3. Still, in one non-limiting embodiment, the area ratio may be at least about 1.1, such as at least about 1.3, or even at least about 1.8. It will be appreciated that the area ratio can be within a range between any of the minimum and maximum values noted above.

In accordance with one embodiment, the shaped abrasive particles of the embodiments herein, including for example, the particle of FIGS. 26A and 26B can have a normalized height difference of at least about 40. The normalized height difference can be defined by the equation [(h1−h2)/(h1/h2)], wherein h1 is greater than h2. In other embodiments, the normalized height difference can be at least about 43, at least about 46, at least about 50, at least about 53, at least about 56, at least about 60, at least about 63, or even at least about 66. Still, in one particular embodiment, the normalized height difference can be not greater than about 200, such as not greater than about 180, not greater than about 140, or even not greater than about 110.

In another embodiment, the shaped abrasive particles herein, including for example, the particle of FIGS. 26A and 26B can have a height variation. Without wishing to be tied to a particular theory, it is thought that a certain height variation between shaped abrasive particles, can improve variety of cutting surfaces, and may improve grinding performance of an abrasive article incorporating the shaped abrasive particles herein. The height variation can be calculated as the standard deviation of height difference for a sample of shaped abrasive particles. In one particular embodiment, the height variation of a sample can be at least about 20. For other embodiments, the height variation can be greater, such as at least about 22, at least about 24, at least about 26, at least about 28, at least about 30, at least about 32, or even at least about 34. Still, in one non-limiting embodiment, the height variation may be not greater than about 180, such as not greater than about 150, or even not greater than about 120. It will be appreciated that the height variation can be within a range between any of the minimum and maximum values noted above.

According to another embodiment, the shaped abrasive particles herein, including for example the particles of FIGS. 26A and 26B can have an ellipsoidal region 1217 in the upper surface 1203 of the body 1201. The ellipsoidal region 1217 can be defined by a trench region 1218 that can extend around the upper surface 1203 and define the ellipsoidal region 1217. The ellipsoidal region 1217 can encompass the midpoint 1281. Moreover, it is thought that the ellipsoidal region 1217 defined in the upper surface can be an artifact of the forming process, and may be formed as a result of the stresses imposed on the mixture during formation of the shaped abrasive particles according to the methods described herein.

Moreover, the rake angle described in accordance with other embodiments herein can be applicable to the body 1201. Likewise, all other features described herein, such as the contours of side surfaces, upper surfaces, and bottom surfaces, the upright orientation probability, primary aspect ratio, secondary aspect ratio, tertiary aspect ratio, and composition, can be applicable to the exemplary shaped abrasive particle illustrated in FIGS. 26A and 26B.

While the foregoing features of height difference, height variation, and normalized height difference have been described in relation to the abrasive particle of FIGS. 26A and 26B, it will be appreciated that such features can apply to any other shaped abrasive particles described herein, including for example, abrasive particles having a substantially trapezoidal two-dimensional shape.

The shaped abrasive particles of the embodiments herein may include a dopant material, which can include an element or compound such as an alkali element, alkaline earth element, rare earth element, hafnium, zirconium, niobium, tantalum, molybdenum, vanadium, or a combination thereof. In one particular embodiment, the dopant material includes an element or compound including an element such as lithium, sodium, potassium, magnesium, calcium, strontium, barium, scandium, yttrium, lanthanum, cesium, praseodymium, niobium, hafnium, zirconium, tantalum, molybdenum, vanadium, chromium, cobalt, iron, germanium, manganese, nickel, titanium, zinc, and a combination thereof.

In certain instances, the shaped abrasive particles can be formed to have a specific content of dopant material. For example, the body of a shaped abrasive particle may include not greater than about 12 wt % for the total weight of the body. In other instances, the amount of dopant material can be less, such as not greater than about 11 wt %, not greater than about 10 wt %, not greater than about 9 wt %, not greater than about 8 wt %, not greater than about 7 wt %, not greater than about 6 wt %, or even not greater than about 5 wt % for the total weight of the body. In at least one non-limiting embodiment, the amount of dopant material can be at least about 0.5 wt %, such at least about 1 wt %, at least about 1.3 wt %, at least about 1.8 wt %, at least about 2 wt %, at least about 2.3 wt %, at least about 2.8 wt %, or even at least about 3 wt % for the total weight of the body. It will be appreciated that the amount of dopant material within the body of the shaped abrasive particle can be within a range between any of the minimum or maximum percentages noted above.

Referring back to FIG. 2, some fibrillated fibers extend between the frontfill layer 18 and the make coat layer 20, spanning the interfacial surfaces where they contact one another. Not wishing to be bound by theory, as discussed above it is believed that the extensions (of the fibrillated fibers in this case) increase the interlayer adhesion, strengthening the overall strength of the abrasive article of the present invention. Alternatively, and as briefly discussed above, the fibrillated fibers may also cause the surfaces of one or more of the layers (the frontfill and the make coat, in this case) to convolute, extend, and/or protrude, thereby increasing layer(s) surface area(s) and interfacial contact.

As further shown in FIG. 2, fibrillated fibers 15 are disposed within the make coat 20 of the abrasive article. While not wishing to be bound by theory, it is believed that the fibrillated fibers of the make coat not only strengthens the make coat layer to help maintain and/or retain the abrasive grains therein, but also retain the abrasive grains in a more desirable orientation. For example, when processing an abrasive article with a make coat, portions of the fibrillated fibers 15 can be made to generally extend through, or penetrate, the surface of the make coat 20 by applying the make coat 20 without the use of a knife, blade spreader, roller or other device that would otherwise encapsulate the fibrillated fibers with make coat material.

FIG. 2 also shows abrasive grains 14 disposed on or within the make coat 20. Abrasive grains 14 may be made to adhere to a make coat by providing opposite charges between the abrasive grains 14 and the make coat 20, thus creating an attractive force that causes the abrasive grains to adhere to the make coat 20. The abrasive grains may be arranged to adhere to the make coat 20 in a particular orientation. During the curing of a make coat, abrasive grains tend to fall over, tilt, or otherwise lose their desired orientation. To this end, and while not wishing to be bound by theory, it is believed that the fibrillated fibers 15 help promote the maintaining of desired abrasive grain orientation by increasing the stiffness of the make coat 20 and/or creating a matrix around the abrasive grains that assists in maintaining their orientation when initially adhered to the make coat 20. Thus, it is further believed that the fibrillated fibers 15 assist in maintaining abrasive grain orientation during grinding operations more than a would an abrasive product that does not have fibrillated fibers. In doing so, it is also believed that the fibrillated fibers 15 assist in retaining the abrasive grains within or on the abrasive product during grinding operations more that an abrasive product that does not have fibrillated fibers. The orientation of the grains can be described as a rake angle. Further, the orientation of the abrasive grains can also be described as a rotational orientation in the Z-direction.

Figure 3:
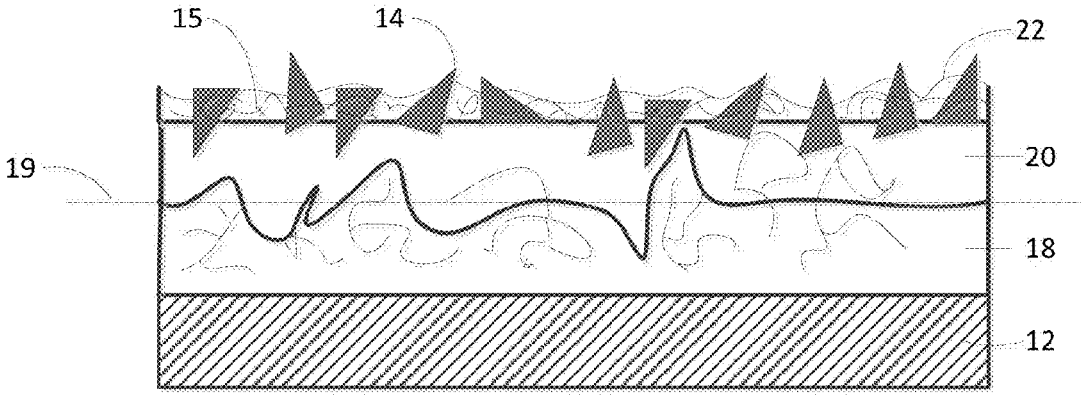
FIG. 3 is an illustration of a cross-section of an embodiment of a coated abrasive article, including a modified size coat.

In another embodiment of the present invention, FIG. 3 shows a size coat 22 disposed on abrasive grains 14 and make coat 20.

The polymer formulation of the size coat of the present invention may be the same as the polymer formulations discussed above with respect to the other layers, such as the frontfill and the make coat, or may include combinations of the components thereof. In particular, as also discussed above, it may be further desirable to include fibrillated fibers in the size coat of the present invention.

As is also shown in FIG. 3, fibrillated fibers 15 are dispersed within the size coat 22. In similar fashion as the embodiment of FIG. 2 described above, fibrillated fibers 15 of the size coat 22, the make coat 20, and/or the frontfill 18 may generally form a matrix around abrasive grains 14. Although FIG. 3 does not show fibrillated fibers dispersed within the make coat 20, it is to be understood that the present invention includes fibrillated fibers that may be included in one or more (including all) layers of an abrasive product. Moreover, although the FIGS. do not show a supersize coat, it is to be understood that a supersize coat may also be included in an embodiment of the present invention, in which case the supersize coat may or may not include fibrillated fibers. As discussed above with respect to the advantages of fibrillated fibers in the make coat 20 of the embodiment of FIG. 2, it is believed that fibrillated fibers in the size coat 22 of the embodiment of FIG. 3 provide similar advantages to the embodiment of FIG. 2, such as, for example, increased coating strength, increased tear strength, increased grinding performance, and increased grinding effect. In either case, an increase in grinding performance can be enjoyed by including fibrillated fibers in an abrasive product having a size coat whether or not the size coat includes fibrillated fibers. The Examples below illustrate the aforementioned improvements.

EXAMPLE 1

Investigating Different Kevlar® Pulp Forms

It is regarded that the best form of fibrillated fiber is one which disperses evenly within a polymer formulation such as, for example, phenolic resin or urea formaldehyde resin. Kevlar® pulp is generally available in three forms, shown in FIGS. as original pulp (FIG. 7A), 50% wet pulp (FIG. 8A), and pre-opened pulp (FIG. 9A). These forms of Kevlar® pulp were investigated to determine which form provides better dispersion into a Phenolic mix.

Original pulp served as the baseline for dispersion measurement in a phenolic resin mix.

50% wet pulp does not disperse well in a phenolic mix using Method 2 described below. Even after mixing, the pulp remained clumped in the pellet form in which it originally came.

Using Method 2 described further herein pre-opened pulp dispersed well into a phenolic mix. Further, draw down tests (as also described further herein) showed more consistent distribution and less clumping with pre-opened Kevlar® pulp than with the other forms of Kevlar® pulp. Pre-opened pulp dispersed best of the three forms in a phenolic mix. However, it is noted that original pulp first mixed dry with dry wollastinite and then added to a phenolic resin mix provided similar dispersion results as the pre-opened pulp mixed directly into a phenolic resin mix.

EXAMPLE 2

Kevlar® Pulp and Phenolic Resin Mix Adhesion

To assess the compatibility of Kevlar® and Phenolic resin, a phenolic resin formulation (typically that used for a make coat) was made and a draw down was performed on a piece of Kevlar® fabric. The Phenolic resin diffused into the Kevalr fibers, showing good adhesion to the Kevlar® fabric.

EXAMPLE 3

Dispersing Kevlar® Pulp Fibers in Phenolic Resin

Establishing that Kevlar® and Phenolic resin adhere well to one another, experiments proceeded to determined which method is best, or most feasible, for dispersing Kevlar® pulp fibers into the Phenolic resin mix. A target coating viscosity of 5000 cps at 100 C using spindle #2 at 12 rpm is typically desired. However, due to the small lab scale mixes (300 grams) of the following examples, target viscosity was measured with spindle #64 at 12 rpm. It should be understood that a target viscosity range is preferably between 200-30,000 cps, more preferably between 2,500-20,000 cps, more preferably between 4,000-10,000 cps, and more preferably between 4,600-5,200 cps. The three methods investigated included:

Method 1 investigated adding the Kevlar® pulp to the standard Phenolic resin mix after Wollastonite has been added and the viscosity of the mix has been adjusted (i.e. lowered) to a target coating viscosity of 5000 cps at 100 C using spindle #64 at 12 rpm. #2 at 12 rpm. The Kevlar® pulp poorly dispersed into the Phenolic resin mix. Instead, it immediately clumped and entangled around the blades of the mixer. It is believed the Kevlar® pulp does not disperse well in relatively low viscosity mixes.

Method 2 investigated adding the Kevlar® pulp to the Pheonolic resin mix before Wollalstonite has been added, where the viscosity of the mix is not adjusted (i.e. lowered). The Kevlar® pulp dispersed better than shown in Method 1, but some clumping still occurred.

Method 3 investigated blending the Kevlar® pulp and Wollastonite together as dry ingredients before adding them to the Phenolic resin mix, where the viscosity of the mix is not adjusted (i.e. lowered). The dry, entangled Kevlar® pulp wa broken up and dispersed throughout the dry Wollastonite mix. This dry mix was then blended into the Phenolic resin mix at a high viscosity. The Kevlar® pulp dispersed very well into the Phenolic resin mix.

Although Method 3 involving blending dry Kevlar® pulp and Wollastonite together before adding the resulting mixture into the Phenolic resin mix proved best for dispersing the Kevlar® pulp, Method 2 was determined to be more feasible for testing constraints at the time.

EXAMPLE 4

Effect of Kevlar® Pulp on Mix Viscosity

Figure 10:
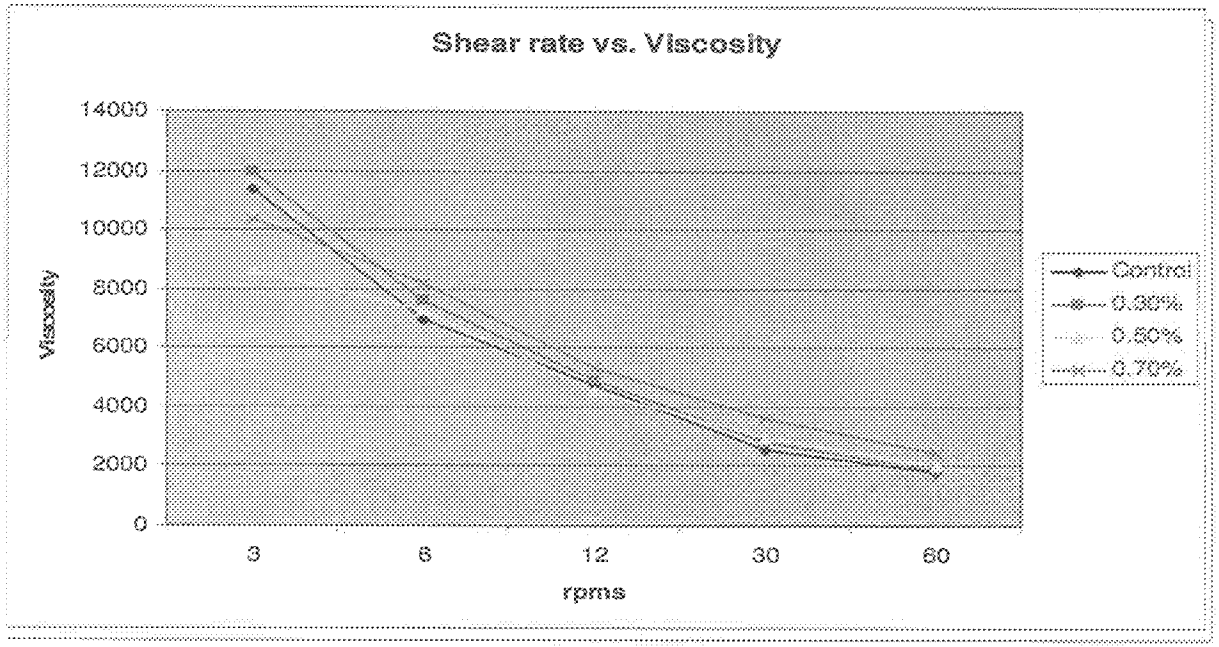
FIG. 10 is a graph plotting shear rate vs. viscosity trends of a control sample not having fibrillated fibers and samples of various wt % Kevlar® formulations made in accordance with some embodiments of the present invention.
Figure 11:
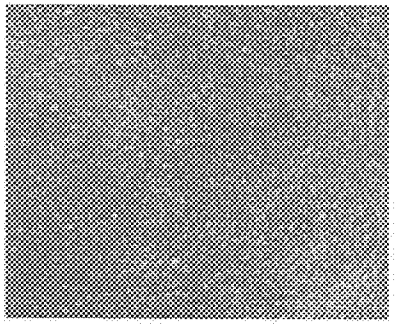
FIG. 11 is a photograph of the result of a draw down test performed on a control sample not having fibrillated fibers.
Figure 12:
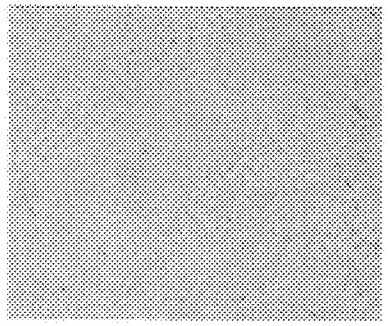
FIG. 12 is a photograph of the result of a draw down test performed on a 0.3 wt % Kevlar® formulation sample made in accordance with one embodiment of the present invention.
Figure 13:
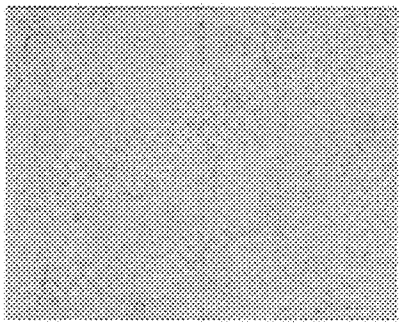
FIG. 13 is a photograph of the result of a draw down test performed on a 0.5 wt % Kevlar® formulation sample made in accordance with one embodiment of the present invention.
Figure 14:
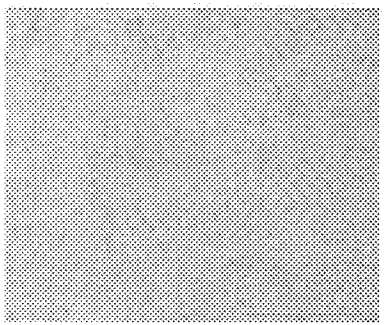
FIG. 14 is a photograph of the result of a draw down test performed on a 0.7 wt % Kevlar® formulation sample made in accordance with one embodiment of the present invention.

Using Method 2, Kevlar® pulp in original form was dispersed into the Phenolic resin to identify the effect of various concentrations of Kevlar® pulp on viscosity of TPS 3500 at different shear rates. A phenolic resin such as TPS 3500 is typically used as a polymeric formulation. The general formulation of TPS 3500 phenolic resin is shown in FIGS. 13 and 14, which show that TPS 3500 typically includes phenolic resin (about 52 wt %), wollastonite filler, (about 42 wt %), defoamer (about 0.11 wt %), witcona (about 0.11 wt %), and water (about 4 wt %). The control mix for this example had no added Kevlar® pulp, for which the general formulation is shown in TABLE 1 above. Four additional mixes were made to include one of either 0.3 wt %, 0.5 wt %, 0.7 wt % or 1.5 wt % Kevlar® pulp (only the 0.5 wt % and the 0.7 wt % formulation are shown in TABLES 2 and 3 above, respectively). Additional water (beyond the about 4% used in the initial formulation) was added to the mix to adjust the viscosity to a target of 5000 cps. A viscosity measurement was taken at different shear rates (3, 6, 12, 30, and 60 rpm) for each mix. As shown in FIG. 10, the results show that the mixes have similar effects with respect to shear rate. However, the 1.5% pulp mix was too viscous, and a stable reading was not able to be taken.

EXAMPLE 5

Effect of Kevlar® Pulp in Coating

Figure 15:
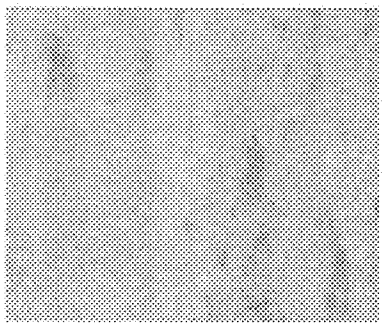
FIG. 15 is a photograph of the result of a draw down test performed on a 1.5 wt % Kevlar® formulation sample made in accordance with one embodiment of the present invention.
Figure 16:
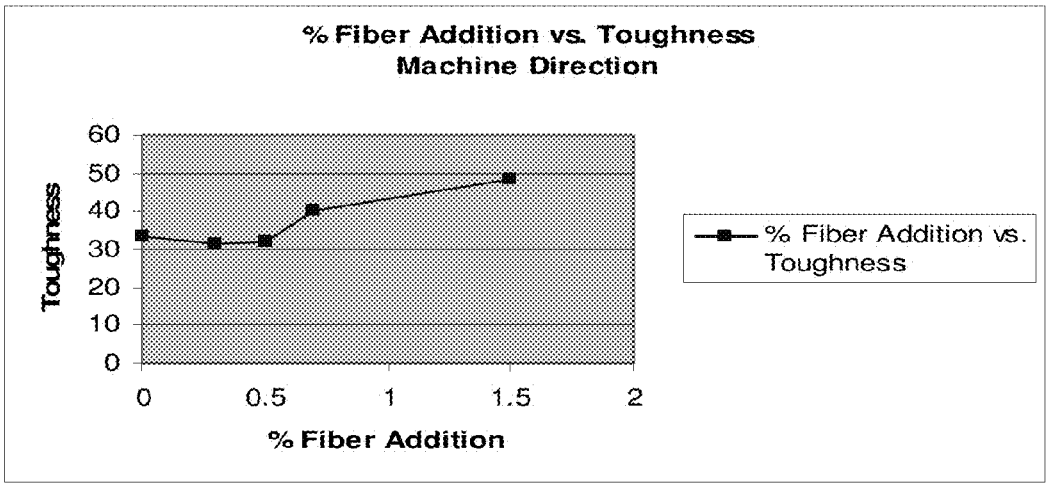
FIG. 16 is a graph plotting toughness measured in the machine direction of various wt % fibrillated fiber polymeric formulations made in accordance with some embodiments of the present invention coated on Monadnock paper.

The four mixes described above in Example 5 (0.3 wt %, 0.5 wt %, 0.7 wt % or 1.5 wt % Kevlar® pulp by weight) were each coated on Monadnock paper and subjected to a draw down test in the machine direction. The drawdown procedure was performed on a square die with a 5 mil gap, as is known in the art. 2-5 grams of resin is placed in the side of the square die and pulled across the substrate. FIGS. 11-15 show the results of the draw down test on each mix. The FIGS. show the fiber strands of the Kevlar® pulp mixes are clearly visible, the visible definition of the strands being more distinct in the mixes with increasing weight percent of Kevlar® pulp. However, as shown in FIG. 15, the 1.5% Kevlar® pulp mix clumps together and does not draw down to the extent of the 0.3%, 0.5%, 0.7% mixes in FIGS. 12, 13, and 14.

EXAMPLE 6

Effect of Kevlar® Pulp on Coating Strength

Figure 17:
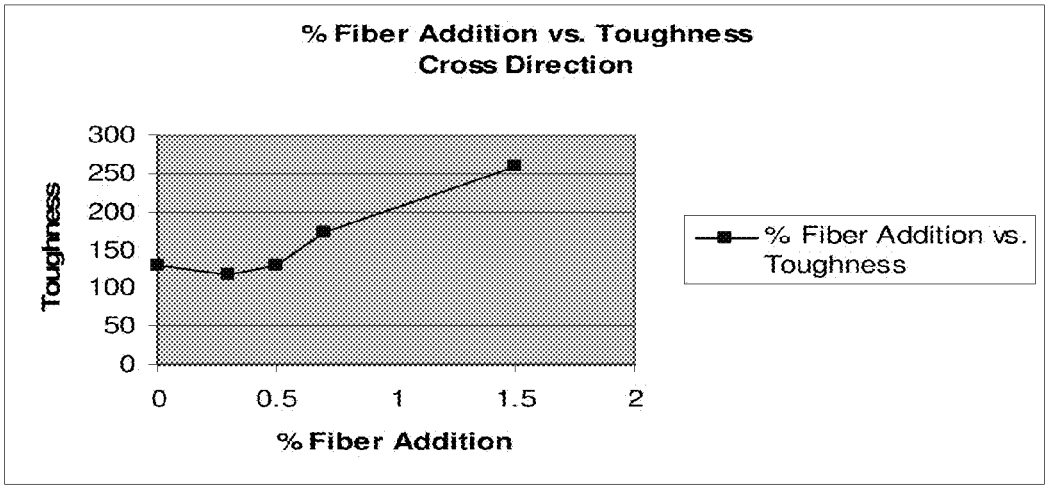
FIG. 17 is a graph plotting toughness measured in the cross direction of various wt % fibrillated fiber polymeric formulations made in accordance with some embodiments of the present invention coated on Monadnock paper.
Figure 18:
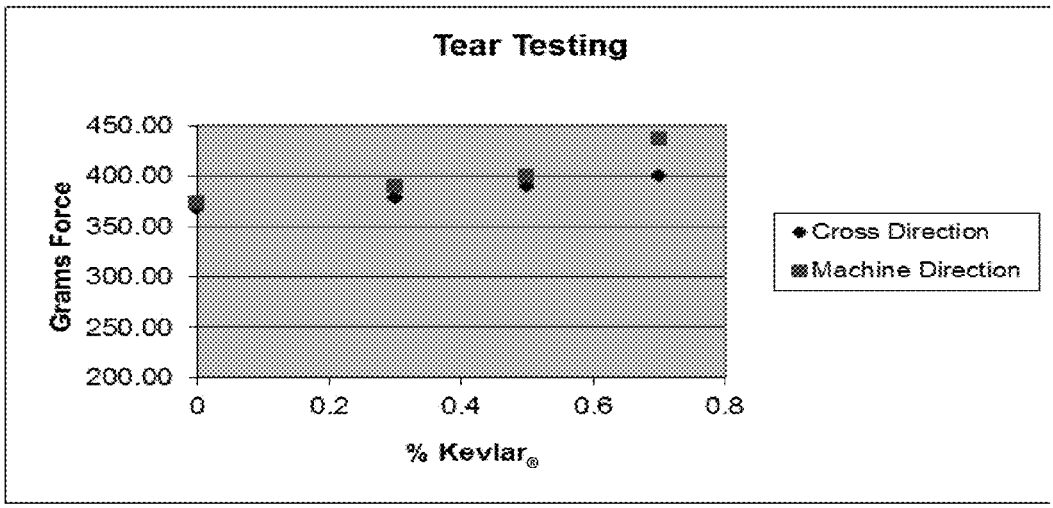
FIG. 18 is a graph showing the results of tear testing various wt % fibrillated fiber polymeric formulations made in accordance with some embodiments of the present invention.

The coated samples of Example 5 were tensile tested to determine if the addition and increase in pulp percent increases the toughness of the coated Monadnock paper in the machine direction and cross direction. As shown in FIGS. 17-18, toughness in both the machine and cross directions increase with by at least the 0.7 wt % Kevlar® sample, and increases further with the 1.5 wt % Kevlar® pulp sample.

EXAMPLE 7

Determining Tear Strength of Pre-Opened Pulp

Three samples of Monadnock paper coated with 0.3 wt %, 0.5 wt %, 0.7 wt % Kevlar® pulp percent by weight were tested for tear strength in both the machine and cross directions against a sample of non-Kevlar® coated Monadnock paper (control). The results are shown in FIG. 18, which shows a steady increase of tear strength (in both the machine and cross directions) with an increase in percent Kevlar®.

EXAMPLE 8

Determining Specific Grinding Energy of Pre-Opened Pulp

Two grinding belts were coated with a 0.5% and a 0.7% percent weight Kevlar® coating, and tested against a control belt with no Kevlar® coating and a belt with Hipal® (high performance alumina) grains. The belts tested are shown in TABLE 7 below.

Belts Made and Tested

TABLE 7

| ID | Grain | Make Formulation | Size Formulation | |
|---|---|---|---|---|
| HiPal/ Blaze Belt | HiPal | Control | Control | Manufacturing |
| Control | DB2473 | Control | Control | Lab experimental |
| 0.5 KP | DB2473 | .5 KP in Control | Control | Lab experimental |
| 0.7 KP | DB2473 | .7 KP in Control | Control | Lab experimental |

The formulations of the control and the belts having Kevlar® pulp fibrillated fibers are shown in TABLES 8-10 below.

TABLE 8

| Control | |
|---|---|
| Component | Wt. % |
| TRM1190 Resin | 52.79% |
| Defoamer TRM1161 | 0.11% |
| Witcona TRM0240 | 0.11% |
| Wollastonite TRM0013 | 42.93% |
| Water | 4.06% |
| Total: | 100.00% |

TABLE 9

| .5% KP | |
|---|---|
| Component | Wt. % |
| TRM1190 Resin | 52.79% |
| Defoamer TRM1161 | 0.11% |
| Witcona TRM0240 | 0.11% |
| Wollastonite TRM0013 | 42.43% |
| Water | 4.06% |
| Pre-opened Kevlar ® Pulp | 0.50% |
| Total: | 100.00% |

TABLE 10

| .7% KP | |
|---|---|
| Component | Wt. % |
| TRM1190 Resin | 52.79% |
| Defoamer TRM1161 | 0.11% |

TABLE 10-continued

| .7% KP | |
|---|---|
| Component | Wt. % |
| Witcona TRM0240 | 0.11% |
| Wollastonite TRM0013 | 42.23% |
| Water | 4.06% |
| Pre-opened Kevlar ® Pulp | 0.70% |
| Total: | 100.00% |

Figure 19:
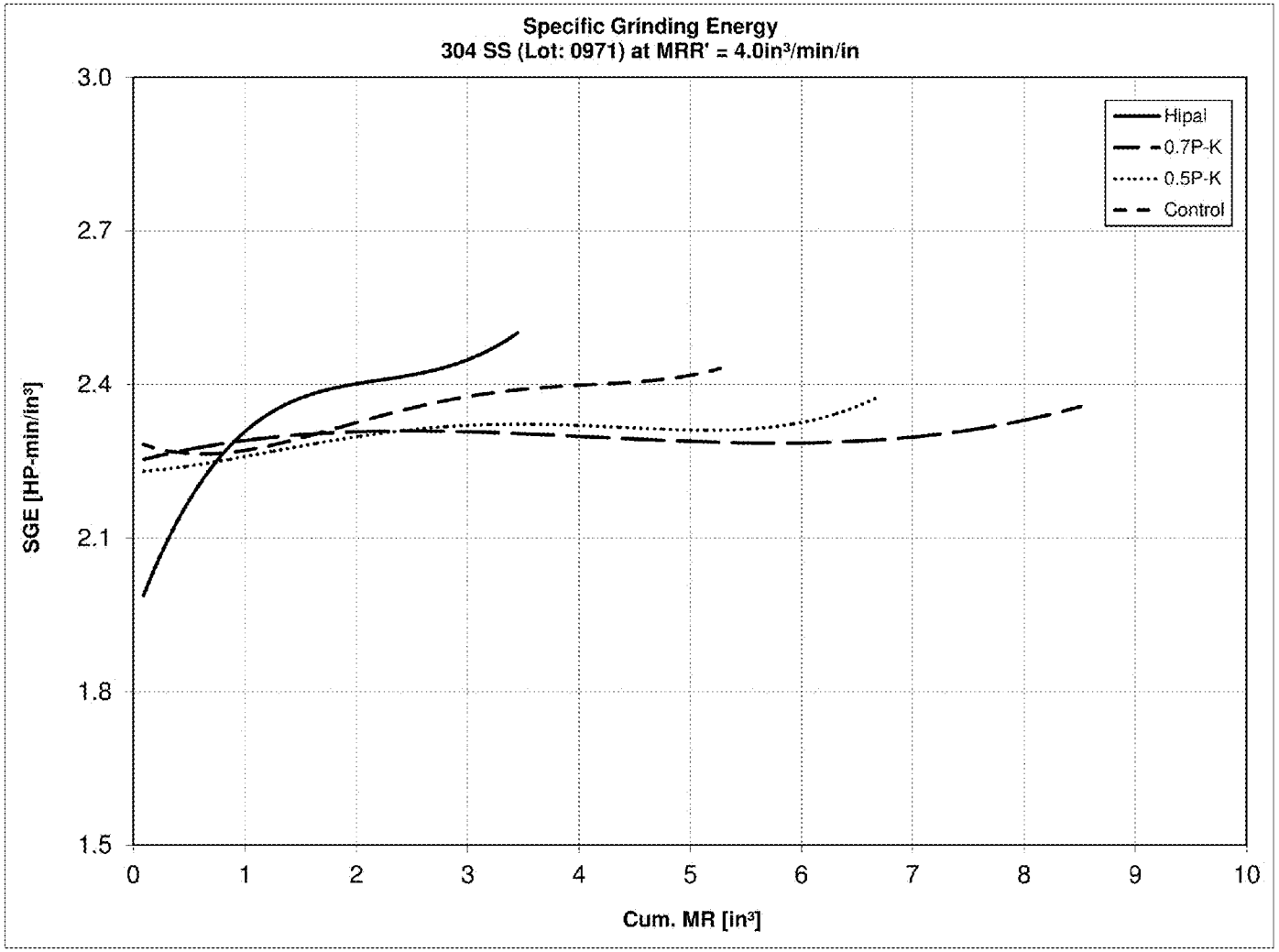
FIG. 19 is a graph plotting specific grinding energy (SGE) vs. cumulative material removed (Cum. MR) of various wt % fibrillated fiber sanding belts made in accordance with some embodiments of the present invention compared to a control belt having no fibrillated fibers and a Hipal belt including hi-performance alumina but no fibrillated fibers.

The results of Example 8 are shown in FIG. 19. As shown in FIG. 19, Hipal® (high-performance alumina) showed impressing material removal at an impressively low specific grinding energy (SGE). However, the Hipal® sample (which did not have fibrillated fibers) quickly required increased SGE and only removed about 3.5 $in^3$ before expiring. The control sample (which also did not have fibrillated fibers) required a steady increase in SGE to maintain material removal, and removed a little more than 5 $in^3$ before expiring. Both the 0.5 wt % (0.5 P-K) and the 0.7 wt % (0.7 P-K) Kevlar® belts showed a more horizontal trend, with the 0.5 wt % Kevlar® belt removing about 6.5 $in^3$ before expiring, and the 0.7 wt % Kevlar® belt removing about 8.5 $in^3$ before expiring. In both cases, neither belt having Kevlar® fibrillated fibers required more than 2.4 SGE, in contrast to the Hipal and control samples. It is noted that a grinding belt typically expires once it reaches or exceed 2.4 SGE.

Without wishing to be constrained by theory, it is believed that the higher performance of grinding belts including Kevlar® pulp is owed to the Kevlar® fibers reinforcing the resins in the frontfill, make coat, and size coat, and by the support and retention of the abrasive grain by the Kevlar® fibers. Further, it is believed that increased performance of the grinding belts is also owed to the Kevlar® fibers helping maintain abrasive grain orientation.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A coated abrasive article comprising:

a backing;

a frontfill disposed on the backing;

a make coat disposed over the frontfill;

abrasive grains disposed on the make coat; and a size coat disposed on the abrasive grains and make coat, wherein fibrillated fibers are dispersed in at least one of the frontfill, make coat, size coat, or combinations thereof, and wherein the fibrillated fibers comprise about 0.1 wt % to 3.0 wt % of the frontfill, about 0.1 wt % to 3.0 wt % of the make coat, or about 0.1 wt% to 3.0 wt % of the size coat.

2. The coated abrasive article of claim 1, wherein the fibrillated fibers have a length between 50 μm and 1000 μm.

3. The coated abrasive article of claim 2, wherein the frontfill, the make coat, or the size coat further comprises at least 10 wt % to not greater than 60 wt % of a filler.

4. The coated abrasive article of claim 2, wherein the fibrillated fibers comprise poly-paraphenylene terephthalamide pulp and wherein the fibrillated fibers comprise about 0.5 wt % to 1.5 wt % of the frontfill, about 0.5 wt % to 1.5 wt % of the make coat, or about 0.5 wt % to 1.5 wt % of the size coat.

5. The coated abrasive article of claim 3, wherein the filler is wollastonite.

6. The coated abrasive article of claim 4, wherein the fibrillated fibers have a specific surface area between 7.00-11.0 $m^2/g$ and a bulk density between 0.0481-0.112g/cc (0.00174-0.0045lb/$in^3$).

* * * * *